US011127361B2

(12) United States Patent
Saruhashi et al.

(10) Patent No.: US 11,127,361 B2
(45) Date of Patent: Sep. 21, 2021

(54) DISPLAY DEVICE

(71) Applicant: Japan Display Inc., Minato-ku (JP)

(72) Inventors: Yasuo Saruhashi, Tokyo (JP); Kazunari Tomizawa, Tokyo (JP)

(73) Assignee: Japan Display Inc., Minato-ku (JP)

( * ) Notice: Subject to any disclaimer, the term of this patent is extended or adjusted under 35 U.S.C. 154(b) by 29 days.

(21) Appl. No.: 16/502,321

(22) Filed: Jul. 3, 2019

(65) Prior Publication Data

US 2020/0013353 A1 Jan. 9, 2020

(30) Foreign Application Priority Data

Jul. 5, 2018 (JP) ..... JP2018-128073

(51) Int. Cl.
*G09G 3/36* (2006.01)

(52) U.S. Cl.
CPC ... *G09G 3/3607* (2013.01); *G09G 2300/0452* (2013.01); *G09G 2320/0666* (2013.01); *G09G 2340/06* (2013.01)

(58) Field of Classification Search
None
See application file for complete search history.

(56) References Cited

U.S. PATENT DOCUMENTS

| | | | | |
|---|---|---|---|---|
| 10,366,664 | B2 | 7/2019 | Tomizawa | |
| 2016/0253943 | A1* | 9/2016 | Wang | H01L 27/3218 345/694 |
| 2018/0315382 | A1* | 11/2018 | Wang | G09G 3/3607 |
| 2018/0374437 | A1 | 12/2018 | Tomizawa et al. | |
| 2019/0051255 | A1* | 2/2019 | Tomizawa | G09G 3/3607 |

FOREIGN PATENT DOCUMENTS

| | | |
|---|---|---|
| JP | 2015-197461 | 11/2015 |
| JP | 2018-21963 A | 2/2018 |
| JP | 2019-8019 A | 1/2019 |

* cited by examiner

*Primary Examiner* — Christopher R Lamb
(74) *Attorney, Agent, or Firm* — Oblon, McClelland, Maier & Neustadt, L.L.P.

(57) ABSTRACT

According to one embodiment, a display device includes a display panel on which first pixels and second pixels are alternately arranged in the columnar direction, and a display controller configured to input a first image signal and to display an image. The first pixels and the second pixels are arranged such that first sub-pixels are adjacent to third sub-pixels in the columnar direction. The display controller is configured to execute conversion of converting the input first image signal into a second image signal, vary the luminance values of the third sub-pixels in the second image signal based on the luminance values of the third sub-pixels in the first image signal which become unable to be represented in the display panel.

14 Claims, 23 Drawing Sheets

PX

DA

| | | | | | | | | | | | | | | | | | | | | | | | |
|---|---|---|---|---|---|---|---|---|---|---|---|---|---|---|---|---|---|---|---|---|---|---|---|
| R | Y1 | G1 | B | Y2 | G2 | R | Y1 | G1 | B | Y2 | G2 | R | Y1 | G1 | B | Y2 | G2 | R | Y1 | G1 | B | Y2 | G2 |
| B | Y2 | G2 | R | Y1 | G1 | B | Y2 | G2 | R | Y1 | G1 | B | Y2 | G2 | R | Y1 | G1 | B | Y2 | G2 | R | Y1 | G1 |
| R | Y1 | G1 | B | Y2 | G2 | R | Y1 | G1 | B | Y2 | G2 | R | Y1 | G1 | B | Y2 | G2 | R | Y1 | G1 | B | Y2 | G2 |
| B | Y2 | G2 | R | Y1 | G1 | B | Y2 | G2 | R | Y1 | G1 | B | Y2 | G2 | R | Y1 | G1 | B | Y2 | G2 | R | Y1 | G1 |
| R | Y1 | G1 | B | Y2 | G2 | R | Y1 | G1 | B | Y2 | G2 | R | Y1 | G1 | B | Y2 | G2 | R | Y1 | G1 | B | Y2 | G2 |
| B | Y2 | G2 | R | Y1 | G1 | B | Y2 | G2 | R | Y1 | G1 | B | Y2 | G2 | R | Y1 | G1 | B | Y2 | G2 | R | Y1 | G1 |
| R | Y1 | G1 | B | Y2 | G2 | R | Y1 | G1 | B | Y2 | G2 | R | Y1 | G1 | B | Y2 | G2 | R | Y1 | G1 | B | Y2 | G2 |

DISPLAY DEVICE

CROSS-REFERENCE TO RELATED APPLICATIONS

This application is based upon and claims the benefit of priority from Japanese Patent Application No. 2018-128073, filed Jul. 5, 2018, the entire contents of which are incorporated herein by reference.

FIELD

Embodiments described herein relate generally to a display device.

BACKGROUND

Plural pixels are arranged on a display device and each of the pixels includes a plurality of sub-pixels. On the display device, each of the sub-pixels outputs light of different colors, and various colors can be thereby reproduced.

In general, each pixel includes three sub-pixels outputting light of, for example, red (R), green (G), and blue (B), respectively, and a display device in which pixels further includes a sub-pixel outputting light of, for example, white (W) in addition to R, G, and B are arranged is known in these days.

When an image signal including luminance values of RGB is input to the display device in which the pixel including four sub-pixels outputting light of RGBW, respectively, is arranged, the image signal needs to be converted into an image signal including luminance values of RGBW.

However, when an image is displayed based on the converted image signal including luminance values of RGBW, the image quality may be degraded.

DETAILED DESCRIPTION

Figure 1:
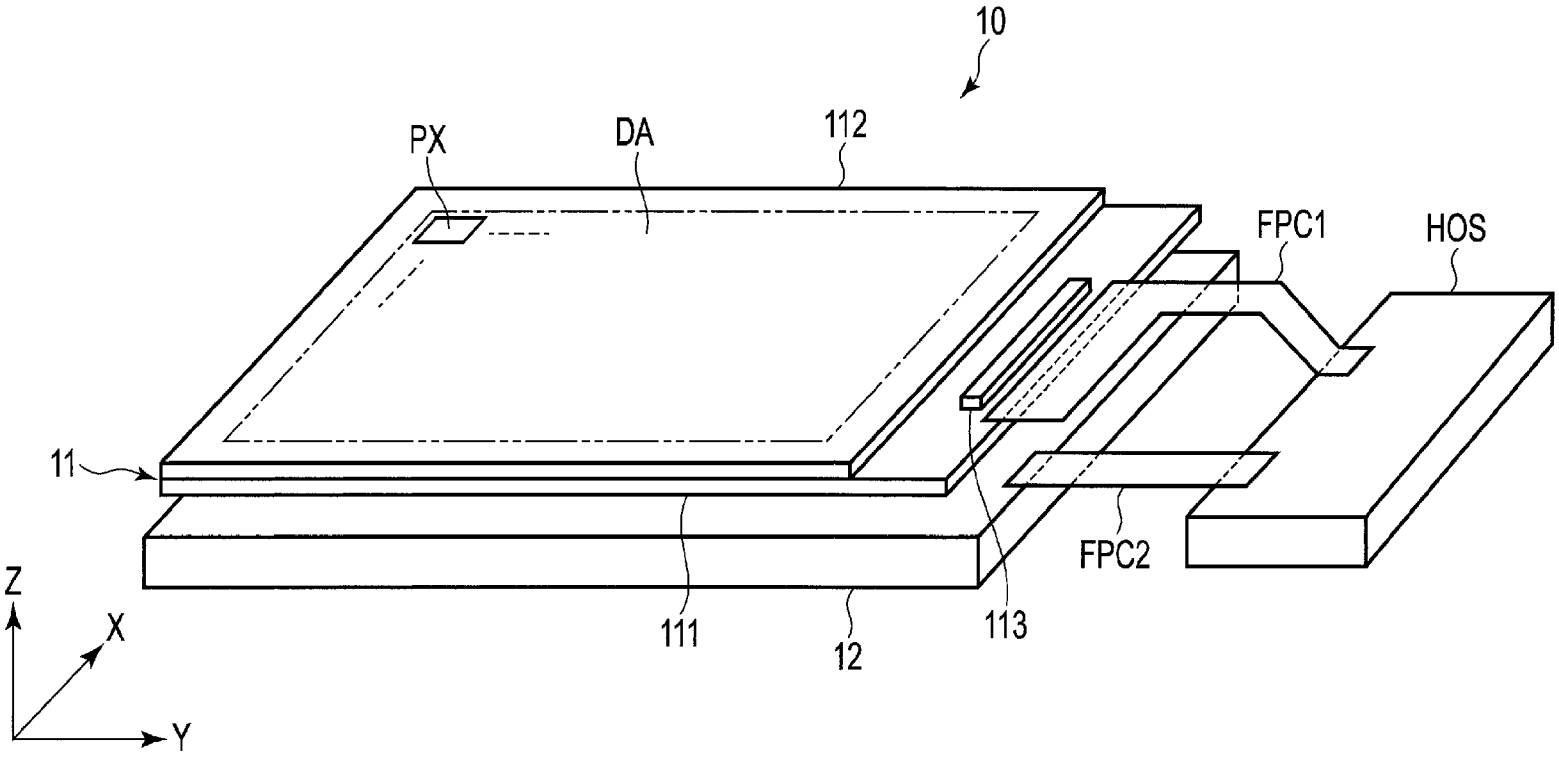
FIG. 1 is a schematic perspective view illustrating a structure of a display device of a first embodiment.

In general, according to one embodiment, a display device includes a display panel on which first pixels including first sub-pixels, second sub-pixels, third sub-pixels, and fourth sub-pixels arrayed in a row direction and constituting a first row of a pixel array, and second pixels including the first sub-pixels, the second sub-pixels, the third sub-pixels, and the fourth sub-pixels arrayed in the row direction and constituting a second row adjacent to the first row in a columnar direction in the pixel array are alternately arranged in the columnar direction, and a display controller configured to input a first image signal including luminance values of the first sub-pixels, the second sub-pixels, and the third sub-pixels corresponding to respective rows of the pixel array and to display an image on the display panel. The first pixels and the second pixels are arranged such that the first sub-pixels included in the first pixels are adjacent to the third sub-pixels included in the second pixels in the columnar direction. The display controller is configured to execute conversion of converting the input first image signal into a second image signal including luminance values of the first sub-pixels, the second sub-pixels, the third sub-pixels, and the fourth sub-pixels, vary the luminance values of the third sub-pixels included in the second image signal, based on the luminance values of the third sub-pixels included in the first image signal which become unable to be represented in the display panel due to the pixel array based on the first pixels constituting the first row and the second pixels constituting the second row, if the conversion is executed, and display the image on the display panel, based on the second image signal in which the luminance values of the third sub-pixels are varied.

Various embodiments will be described hereinafter with reference to the accompanying drawings.

The disclosure is merely an example, and proper changes in keeping with the spirit of the invention, which are easily conceivable by a person of ordinary skill in the art, come within the scope of the invention as a matter of course. In addition, in some cases, in order to make the description clearer, the inventions are illustrated schematically in the drawings, rather than as an accurate representation of what is implemented. However, such schematic illustration is merely exemplary, and in no way restricts the interpretation of the invention. In the drawings, reference numbers of continuously arranged elements equivalent or similar to each other are omitted in some cases. In addition, in the specification and drawings, structural elements which function in the same or a similar manner to those described in connection with preceding drawings are denoted by like reference numbers, detailed description thereof being omitted unless necessary.

First Embodiment

FIG. 1 is a schematic perspective view of the structure of a display device of an embodiment. FIG. 1 illustrates a three-dimensional space which is defined by a first direction X, a second direction Y orthogonal to the first direction X, and a third direction Z orthogonal to the first direction X and the second direction Y. The first direction X and the second direction Y are orthogonal to each other, but may intersect at an angle other than 90°. In addition, the third direction Z is defined as an upper or upward direction while a direction opposite to the third direction Z is defined as a lower or downward direction, in the present embodiment. According to "a second member above/on a first member" and "a second member below/under a first member", the second member may be in contact with the first member or may be remote from the first member.

In the following descriptions, a display device 10 is explained as a liquid crystal display device using a liquid crystal layer, in the present embodiment, but the display device 10 may be an organic electroluminescent (EL) display device using an organic emitting layer, an LED display device using a light-emitting diode (LED), or the like.

The display device 10 illustrated in FIG. 1 includes a display panel 11. The display panel 11 has, for example, a rectangular shape. In the example illustrated, shorter sides of the display panel 11 are parallel to the first direction X while longer sides of the display panel 11 are parallel to the second direction Y. The third direction Z corresponds to a direction of thickness of the display panel 11. The main surface of the display panel 11 is parallel to an X-Y plane defined by the first direction X and the second direction Y.

The display panel 11 includes a first substrate 111 (array substrate), a second substrate 112 (counter-substrate) opposed to the first substrate 111, and a liquid crystal layer (not illustrated) formed between the first substrate 111 and the second substrate 112. For example, a panel driver (display control unit) 113 which drives the display panel 11 is mounted on the first substrate 111.

In addition, the display panel 11 includes a display area DA as an area in which images are displayed. Pixels PX are arranged (arrayed) in the display area DA (display panel 11).

Furthermore, for example, a host device HOS is provided outside the display panel 11, and the host device HOS is connected to the display panel 11 via a flexible printed circuit FPC1 and the panel driver 113.

The panel driver 113 can display images on the display panel 11 by, for example, inputting an image signal output from the host device HOS and driving each of the pixels PX arrayed in the display area DA based on the image signal.

A backlight unit 12 serving as an illumination device which illuminates the display panel 11 is disposed on a lower side of the first substrate 111 (i.e., a back side of the display panel 11). The flexible printed circuit FPC2 connects the backlight unit 12 with the host device HOS. Various types of backlight units can be employed as the backlight unit 12, and some backlight units use a light-emitting diode (LED), a cold-cathode tube (CCFL) and the like, as the light source. The backlight unit 12 disposed on the back side of the display panel 11 is used here, but a front light disposed on a display surface side of the display panel 11 may be used. Alternatively, an illumination unit using a light guide and an LED or a cold-cathode tube disposed on the side of the light guide may be used or an illumination unit using spotlight source in which light-emitting elements are arranged in a plane may be used. If the display device 10 is an organic EL display device or an LED display device, the display device 10 may not include an illumination unit.

In addition, the display panel 11 of the present embodiment may be any one of a transmissive display panel, a reflective display panel and a transflective display panel. The display device 10 using the transmissive display panel 11 includes the backlight unit 12 on the back side of the first substrate 111 and has a transmissive display function of displaying images by urging the light from the backlight unit 12 to be selectively transmitted. The display device 10 using the reflective display panel 11 includes a reflective layer to reflect the light, on the back side of the display panel 11, and has a reflective display function of displaying images by selectively reflecting the light from the front side (or the display surface side) of the second substrate 112. An auxiliary light source may be disposed on the front surface side of the reflective display panel 11. In addition, the reflective layer may be configured to form an electrode of a material having the reflecting function such as a metal or the like, on the back side of the display panel 11 rather than the liquid crystal layer. The display device 10 using the transflective display panel 11 has both the transmissive display function and the reflective display function.

Figure 2:
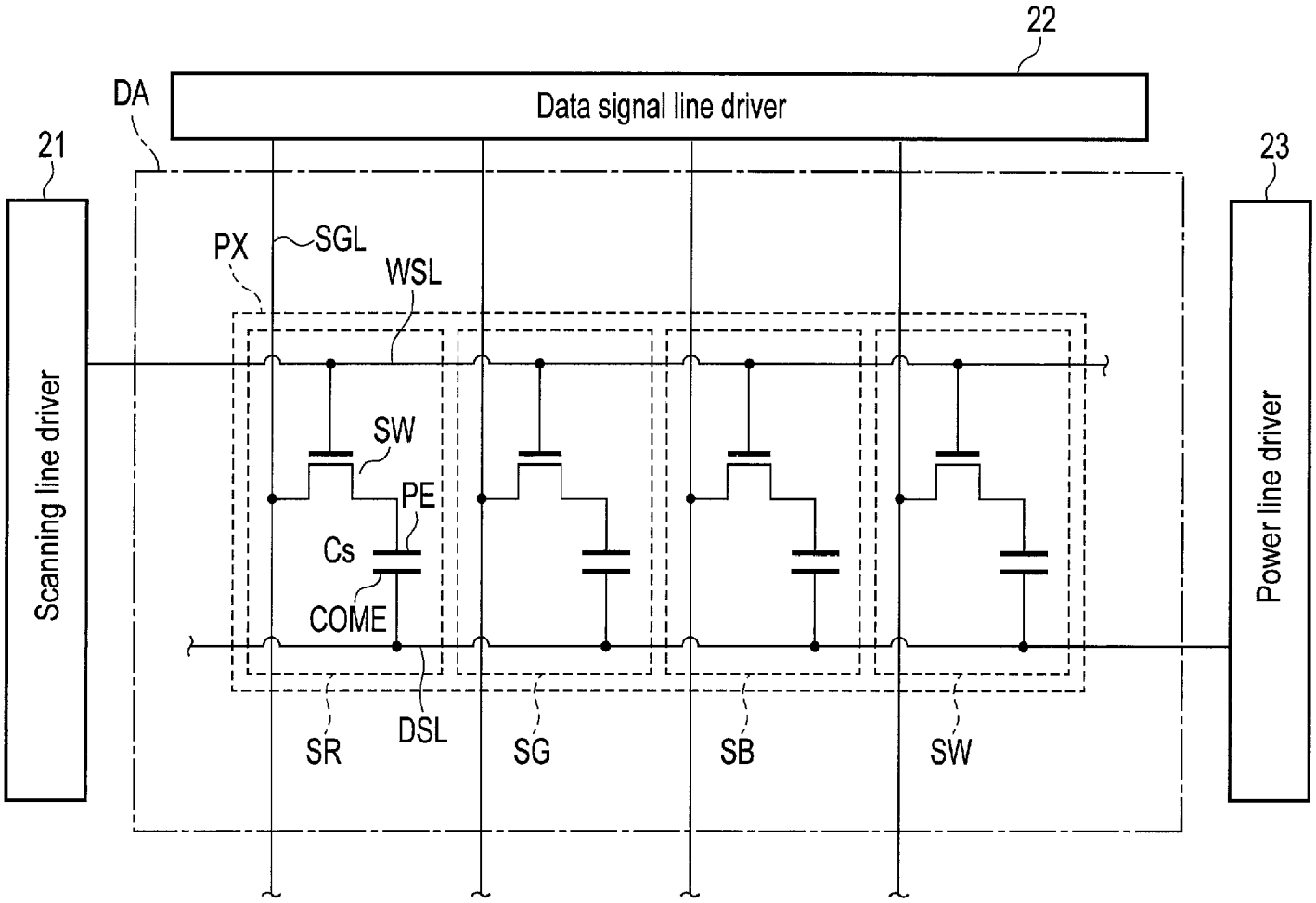
FIG. 2 is a diagram illustrating an example of a circuit configuration of the display device.

FIG. 2 illustrates an example of a circuit configuration of the display device illustrated in FIG. 1. In FIG. 2, the display device 10 includes a scanning line driver 21, a data signal line driver 22, and a power line driver 23.

The pixels PX are arrayed in the display area DA of the display panel 11. In FIG. 2, only one of the pixels PX is illustrated for convenience of descriptions. Details of the arrangement (pixel array) of the pixels PX in the present embodiment will be described later.

The pixel PX includes, for example, four sub-pixels SR, SG, SB, and SW. The sub-pixel SR is a sub-pixel which outputs light corresponding to a red wavelength band (light of a red component). The sub-pixel SG is a sub-pixel which outputs light corresponding to a green wavelength band (light of a green component). The sub-pixel SB is a sub-pixel which outputs light corresponding to a blue wavelength band (light of a blue component). The sub-pixel SW is a sub-pixel which outputs light corresponding to a white wavelength band (light of a white component). In the pixel PX, for example, the sub-pixels SR, SG, SB, and SW are arrayed side by side in the row direction (second direction Y).

In addition, in the display area DA, scanning lines WSL extending along the row direction of the pixels PX, power lines DSL extending parallel to the scanning lines WSL, and data signal lines SGL extending in the columnar direction (first direction) of the pixels PX are further arranged. One of ends of the scanning line WSL is connected to the scanning line driver 21. One of ends of the data signal line SGL is connected to the data signal line driver 22. One of ends of the power line DSL is connected to the power line driver 23.

The above-explained sub-pixels SR, SG, SB, and SW are arranged at intersections of the scanning lines WSL and the data signal lines SGL.

Next, a configuration of the sub-pixel SR will be explained. As illustrated in FIG. 2, the sub-pixel SR includes a pixel switch SW. The pixel switch SW includes a thin-film transistor (TFT). A gate electrode of the pixel switch SW is electrically connected to the corresponding scanning line SWL. One of a source electrode and a drain electrode of the pixel switch SW is electrically connected to the corresponding signal line SGL. The other of the source electrode and the drain electrode of the pixel switch SW is electrically connected to the corresponding pixel electrode PE.

The scanning line driver 21 applies an on voltage to the scanning line WSL and supplies the on voltage to the gate electrode of the pixel switch SW electrically connected to the scanning line WSL. According to this, the source electrode and the drain electrode of the pixel switch SW having the gate electrode supplied with the on voltage become electrically conductive.

The data signal line driver 22 supplies the corresponding output signal (image signal) to each of the signal lines SGL. The signal supplied to the signal line SGL is applied to the corresponding pixel electrode PE via the pixel switch SW in which the source electrode and the drain electrode are electrically conductive.

The power line driver 23 supplies a drive signal (applies a drive voltage) to a common electrode COME. The pixel electrode PE and the common electrode COME are opposed to each other through an insulating film. The pixel electrode PE, the common electrode COME, and the insulating film form a storage capacitor CS.

The sub-pixel SR is explained here, but the other sub-pixels SG, SB, and SW have the same configuration.

The scanning line driver 21, the data signal line driver 22, and the power line driver 23 are disposed in a surrounding area (frame) of the display panel 11 and controlled by the above-explained panel driver 113. The panel driver 113 also controls the operation of the backlight unit 12 though not illustrated.

Only one scanning line driver 21 is illustrated in FIG. 2, but the display panel 11 may include a plurality of scanning line drivers 21. For example, if the display panel includes two scanning line drivers 21, some of the scanning lines WSL can be connected to one of the scanning line driver 21 and the remaining scanning lines WSL can be connected to the other scanning line driver 21. If the display panel includes two scanning line drivers 21, the scanning line drivers 21 are disposed to be opposed to each other with the pixels PX interposed therebetween.

Figure 3:
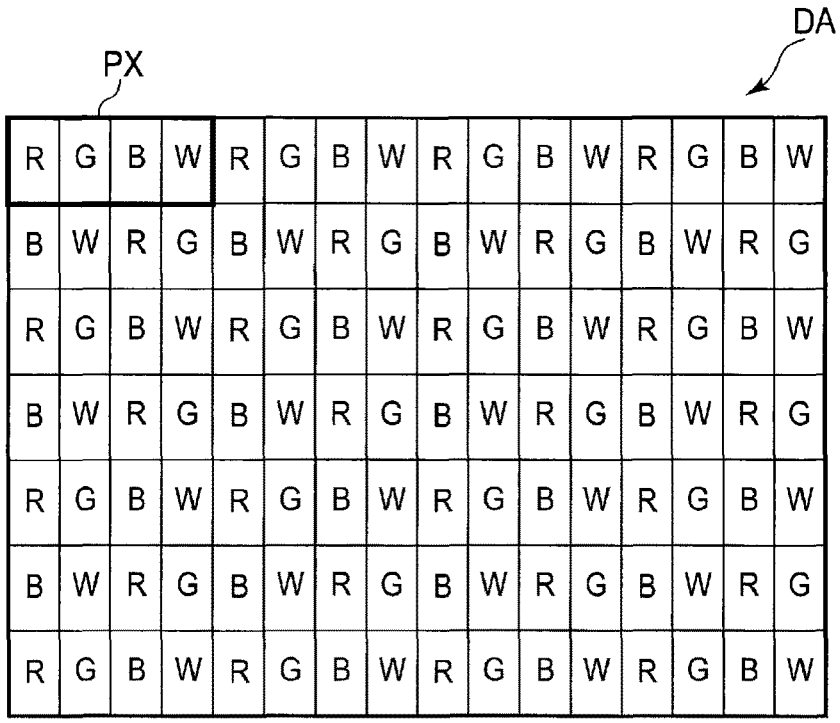
FIG. 3 is a diagram illustrating an example of pixel array in the embodiment.

The pixel array in the present embodiment will be explained with reference to FIG. 3. FIG. 3 simply illustrates the arrangement (pixel array) of the pixels PX arrayed on the display panel 11 (display area DA) in the present embodiment.

In the present embodiment, each of the pixels PX arranged on the display panel 11 includes the sub-pixels SR, SG, SB, and SW as described above. Blocks arranged in a matrix in FIG. 3 represent the sub-pixels included in each of the pixels PX. In addition, the block referred to as "R" represents sub-pixel SR, the block represented by "G" represents sub-pixel SG, the block referred to as "B" is sub-pixel SB, and the block referred to as "W" represents sub-pixel SW. The blocks are also illustrated in similar manners in the following drawings.

Odd-numbered rows (for example, first row and the like) of the pixel array in the present embodiment are constituted such that the pixels PX including the sub-pixels SR, SG, SB, and SW arranged in the row direction are arranged in the row direction, as illustrated in FIG. 3. Similarly, even-numbered rows (for example, second row and the like) of the pixel array in the present embodiment are constituted such that the pixels PX including the sub-pixels SR, SG, SB, and SW arranged in the row direction are arranged in the row direction. On the display panel 11, the pixels PX constituting the odd-numbered rows (hereinafter referred to as pixels PX of odd-numbered rows) and the pixels PX constituting the even-numbered rows (hereinafter referred to as pixels PX of even-numbered rows) are alternately arranged in the columnar direction.

Figure 4:
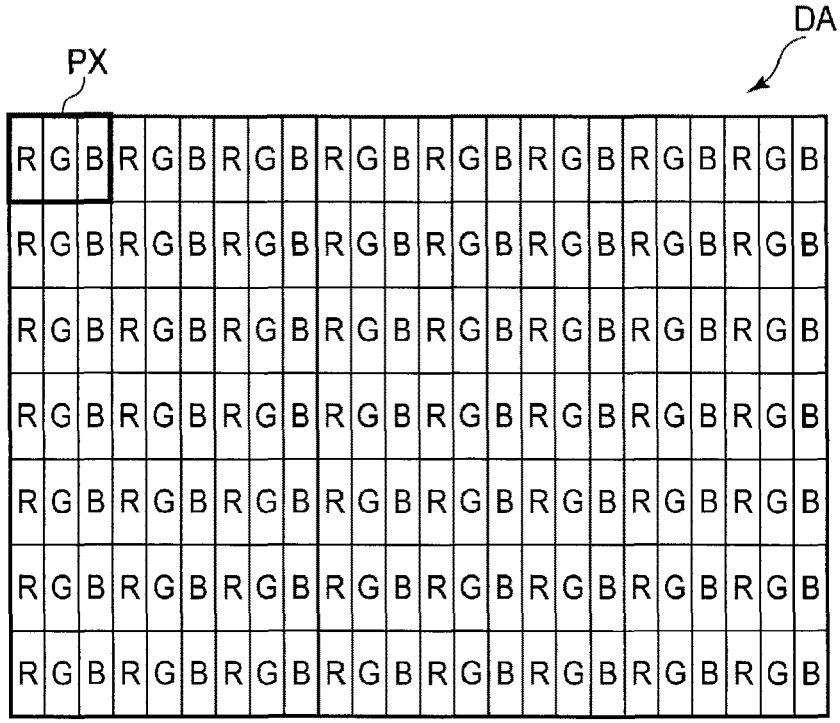
FIG. 4 is a diagram illustrating an example of pixel array in a case where each pixel includes three sub-pixels.

If each of the pixels PX include the sub-pixels SR, SG, SB, and SW as explained above, for example, power consumption of the backlight unit 12 can be suppressed since the area in which the light is transmitted becomes larger and the lightness can be thereby improved as compared with, for example, a pixel PX including the sub-pixels SR, SG, and SB illustrated in FIG. 4.

In the present embodiment, the pixels PX of odd-numbered rows and the pixels PX of even-numbered rows are arranged such that the sub-pixels SR included in the pixels PX of odd-numbered rows are adjacent to the sub-pixels SB included in the pixels PX of even-numbered rows in the columnar direction. In other words, in the present embodiment, the pixels PX of odd-numbered rows and the pixels PX of even-numbered rows are arranged to be shifted by half pixel in the row direction.

In this pixel array, the sub-pixels SR are arranged at start ends of the odd-numbered rows while the sub-pixels SW are arranged at terminal ends of the odd-numbered rows. In addition, the sub-pixels SB are arranged at start ends of the even-numbered rows while the sub-pixels SG are arranged at terminal ends of the even-numbered rows.

This pixel array has an advantage that the resolution can be improved as compared with a case where, for example, the sub-pixels included in the pixels PX of odd-numbered rows and the sub-pixels included in the pixels PX of even-numbered rows are arrayed to match.

Figure 5:
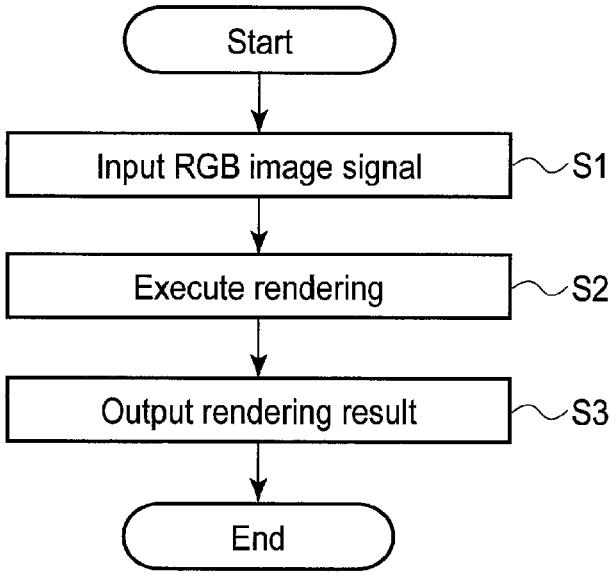
FIG. 5 is a flow chart illustrating an example of procedure of the display device in a case of displaying the image on a display panel.

Next, a procedure of the display device 10 displaying the images on the display panel 11 will be explained with reference to a flowchart of FIG. 5. The processing executed by the panel driver 113 will be mainly explained here.

First, the panel driver 113 inputs, for example, the image signal output from the host device HOS (step S1). The image signal input in step S1 is assumed to be an image signal (hereinafter referred to as RGB image signal) including the luminance value of the sub-pixels SR, SG, and SB for each pixel to display, for example, a one-frame image. In the present embodiment, the luminance value included in the image signal is assumed to include a concept of a signal value of the image signal.

The sub-pixels SR, SG, SB, and SW are included in each of the pixels PX arranged on the display panel 11 as explained above. In this case, since the RGB image signal input in step S1 does not correspond to the display panel 11 (i.e., is not an image signal including the luminance values of the sub-pixels SR, SG, SB, and SW), the RGB image signal needs to be converted into an RGBW image signal when the images are displayed on the display panel 11 based on the RGB image signal. The RGBW image signal is an image signal including the luminance values of the sub-pixels SR, SG, SB, and SW for each pixel PX.

For this reason, the panel driver 113 executes rendering for the RGB image signal input in step S1 (step S2). The rendering in the present embodiment includes processing of converting the RGB image signal (luminance values of the sub-pixels SR, SG, and SB included in the RGB image signal) into the RGBW image signal (luminance values of the sub-pixels SR, SG, SB, and SW), and the like.

When the processing in step S2 is executed, the panel driver 113 outputs the RGBW image signal as a result of the rendering in step S2 (step S3). The panel driver 113 thereby drives the scanning line driver 21, the data signal line driver 22, the power line driver 23, and the like based on the RGBW image signal to display images on the display panel 11.

The rendering in the present embodiment (processing in step S2 illustrated in FIG. 5) will be explained below in detail.

First, processing (hereinafter referred to as conversion) of converting the RGB image signal (luminance values of the sub-pixels SR, SG, and SB) into the RGBW image signal (luminance values of the sub-pixels SR, SG, SB, and SW) in the rendering will be explained with reference to FIG. 6.

In the present embodiment, the RGB image signals for two pixels (i.e., the luminance values of the sub-pixels SR, SG, and SB for two pixels) are converted into the RGBW image signal for one pixel (i.e., the luminance values of the sub-pixels SR, SG, SB, and SW for one pixel) such that the area of light transmission becomes larger as described above.

Figure 6:
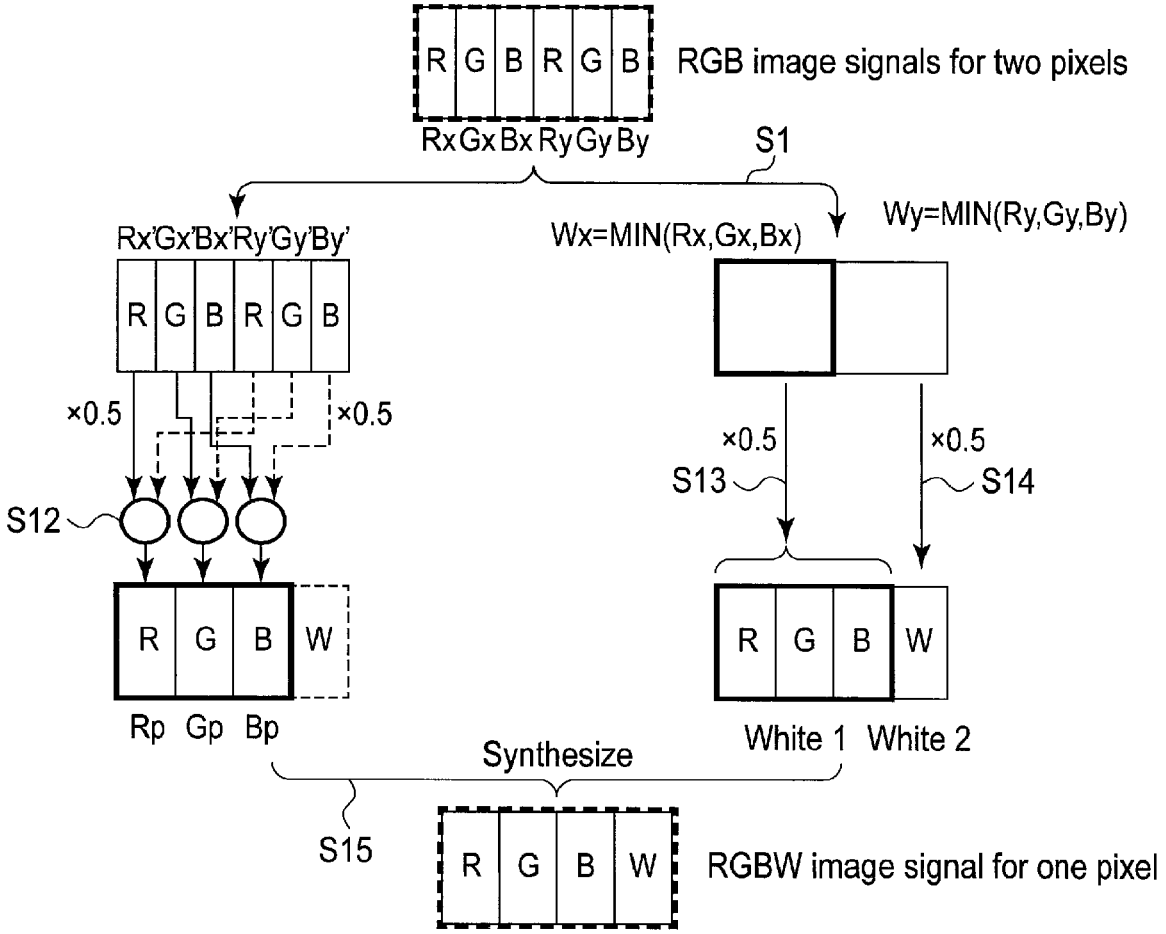
FIG. 6 is a diagram illustrating an example of conversion of converting an RGB image signal into an RGBW image signal.

As illustrated in FIG. 6, the luminance values of the sub-pixels SR, SG, and SB included in either RGB image signal for one pixel (hereinafter referred to as first RGB image signal) of the RGB image signals for two pixels that are to be converted into the RGBW image signal for one pixel are Rx, Gx, and Bx, and the luminance values of the sub-pixels SR, SG, and SB included in the other RGB image signal for one pixel (hereinafter referred to as second RGB image signal) are Ry, Gy, and By.

In the conversion, a white component and color components other than the white component are extracted from each of the first RGB image signal and the second RGB image signal (step S11).

In the case of the first RGB image signal, a white component Wx having the minimum value of the luminance values Rx, Gx, and Bx of the sub-pixels SR, SG, and SB is extracted, and the luminance values of the sub-pixels SR, SG, and SB obtained by excluding the white component Wx from the luminance values Rx, Gx, and Bx are extracted as color components. More specifically, for example, if (Rx, Gx, Bx) are (255, 128, 255), the white component Wx (R, G, B)=(128, 128, 128) and the color components (R, G, B)=(127, 0, 127) are extracted.

In the case of the second RGB image signal, a white component Wy having the minimum value of the luminance values Ry, Gy, and By of the sub-pixels SR, SG, and SB is extracted, and the luminance values of the sub-pixels SR, SG, and SB obtained by excluding the white component Wy from the luminance values Ry, Gy, and By are extracted as color components.

Next, the processing in step S12 is executed. In step S12, the luminance value (hereinafter referred to as luminance value Rp) of the sub-pixel SR in the RGBW image signal is computed based on the luminance value (hereinafter referred to as luminance value Rx') of the sub-pixel SR included in the color components extracted from the first RGB image signal and the luminance value (hereinafter referred to as luminance value Ry') of the sub-pixel SR included in the color components extracted from the second RGB image signal. In this case, a value of summing a value obtained by multiplying the luminance value Rx' by 0.5 and a value obtained by multiplying the luminance value Ry' by 0.5 is computed as luminance value Rp.

Computing the luminance value Rp of the sub-pixel SR in the RGBW image signal is explained here, but the luminance values of the sub-pixels SG and SB are also obtained in a similar manner in step S12.

That is, in step S12, the luminance value (hereinafter referred to as luminance value Rp) of the sub-pixel SG in the RGBW image signal is computed by summing a value obtained by multiplying by 0.5 the luminance value (hereinafter referred to as luminance value Gx') of the sub-pixel SG included in the color components extracted from the first RGB image signal and a value obtained by multiplying by 0.5 the luminance value (hereinafter referred to as luminance value Gy') of the sub-pixel SG included in the color components extracted from the second RGB image signal.

Similarly, in step S12, the luminance value (hereinafter referred to as luminance value Bp) of the sub-pixel SB in the RGBW image signal is computed by summing a value obtained by multiplying by 0.5 the luminance value (hereinafter referred to as luminance value Bx') of the sub-pixel SB included in the color components extracted from the first RGB image signal and a value obtained by multiplying by 0.5 the luminance value (hereinafter referred to as luminance value By') of the sub-pixel SB included in the color components extracted from the second RGB image signal.

In step S12, the luminance values of the sub-pixels SR, SG, and SB in the RGBW image signal are computed based on the color components extracted from the first RGB image signal and the color components extracted from the second RGB image signal.

In contrast, the luminance values of the sub-pixels SR, SG, and SB in the RGBW image signal are also computed, similarly, from the white component extracted from the first RGB image signal (step S13). In this case, values obtained by multiplying the luminance values of the sub-pixels SR, SG, and SB included in the white component extracted from the first RGB image signal by 0.5 are computed as the luminance values of the sub-pixels SR, SG, and SB in the RGBW image signal.

In addition, regarding the white component extracted from the second RGB image signal, values obtained by multiplying the luminance values of the sub-pixels SR, SG, and SB included in the white component by 0.5 are computed as the luminance value of the sub-pixel SW in the RGBW image signal (step S14).

Finally, the RGBW image signal including the luminance values of the sub-pixels SR, SG, SB, and SW is generated by synthesizing (summing) the values computed as the luminance values of the sub-pixels SR, SG, and SB in the RGBW image signal in step S12, the values computed as the sub-pixels SR, SG, and SB in the RGBW image signal in step S13, and the value computed as the luminance value of the sub-pixel SW in the RGBW image signal in step S14.

In the present embodiment, the RGB image signal to display a one-frame image can be converted into the RGBW image signal by executing the above processing for each RGB image signal for two pixels.

Figure 7:
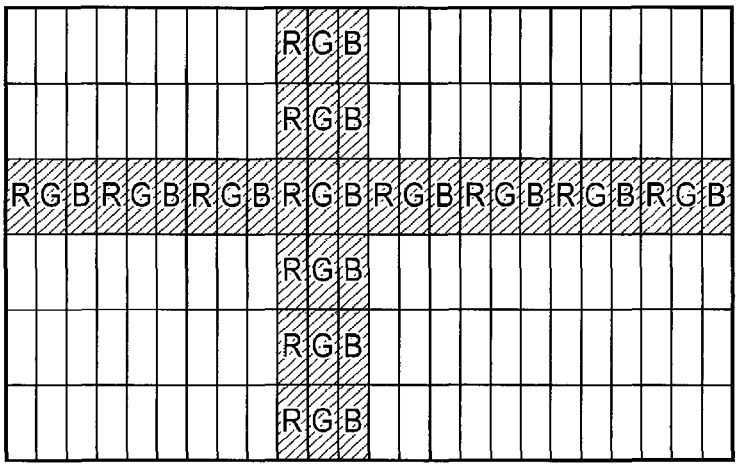
FIG. 7 is a diagram illustrating an example of the RGB image signal to display white cross lines.
Figure 8:
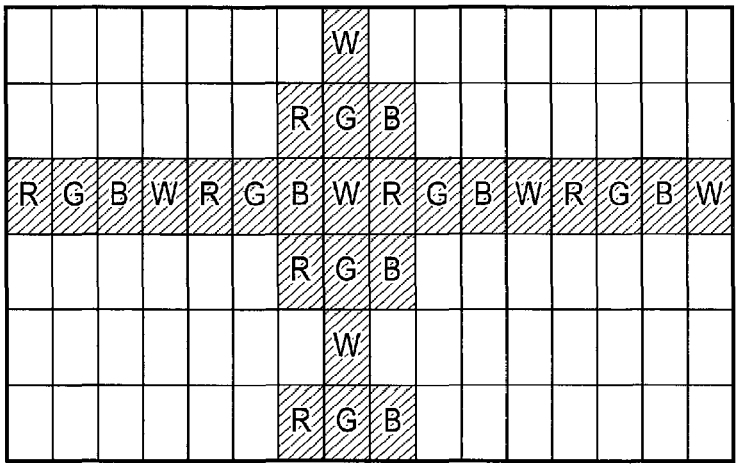
FIG. 8 is a diagram illustrating an example of the RGBW image signal into which the RGB image signal is converted.

White color is reproduced by outputting the light from the sub-pixels SR, SG, and SB but, for example, when the RGB image signal to display a white cross line is input by outputting the light from the sub-pixels SR, SG, and SB as illustrated in FIG. 7, the RGB image signal is converted into the RGBW image signal which allows the light to be output from the sub-pixels SR, SG, SB, and SW as illustrated in FIG. 8. In FIG. 7 and FIG. 8, hatched blocks represent positions of the sub-pixels outputting the light based on the image signals.

Incidentally, when the RGB image signals for two pixels are converted into the RGBW image signal for one pixel, in the present embodiment, the luminance values computed from the color components extracted from the first RGB image signal and the color components extracted from the second RGB image signal in step S12 illustrated in FIG. 6 need to be allocated to the sub-pixels (i.e., the sub-pixels in the RGBW image signal) of appropriate positions.

A sub-pixel to which the luminance value computed from a color component extracted from the first RGB image signal and a color component extracted from the second RGB image signal is allocated will be concretely explained below. The sub-pixel SR will be mainly explained here but the other sub-pixels SG and SB have the same configuration.

First, a case where none of the luminance value Rx' of the sub-pixel SR included in the color components extracted from the first RGB image signal and the luminance value Ry' of the sub-pixel SR included in the color components extracted from the second RGB image signal is 0 will be explained with reference to FIG. 9. In this case, the value of summing the value obtained by multiplying the luminance value Rx' by 0.5 and the value obtained by multiplying the luminance value Ry' by 0.5 is computed as the luminance value Rp (i.e., the luminance value of the sub-pixel SR in the RGBW image signal) as explained in step S12 of FIG. 6. If the luminance value Rx' is not 0 but the luminance value Ry' is 0, the value obtained by multiplying the luminance value Rx' by 0.5 becomes the luminance value Rp.

Next, a case where the luminance value Rx' is 0 while the luminance value Ry' is not 0 will be explained with reference to FIG. 10. In this case, if the value obtained by, for example, multiplying the luminance value Ry' by 0.5 is added to the luminance value Rp (i.e., this value is allocated to the sub-pixel SR having the luminance value Rp) although the luminance value Rx' is 0, an image (shape) different from the image to be displayed may be displayed. For this reason, if the luminance value (hereinafter referred to as luminance value Rz') of the sub-pixel SR next to the sub-pixel SR having the luminance value Ry' is not 0 in the case where the luminance value Rx' is 0 while the luminance value Ry' is not 0, the value obtained by multiplexing the luminance value Ry' by 0.5 is added to the luminance value Rp' of the sub-pixel SR next to the sub-pixel SR having the luminance value Rp. In other words, the value (luminance value) obtained by multiplying the luminance value Ry' by 0.5 is moved to adjacent sub-pixel SR in the case illustrated in FIG. 10.

Next, a case where the luminance value Rx' is 0 and the luminance value Ry' is not 0, similarly to FIG. 10, and the luminance value Rz' is 0 will be explained with reference to FIG. 11. In this case, if the value obtained by, for example, multiplying the luminance value Ry' by 0.5 is added to the luminance value Rp' (i.e., this value is allocated to the sub-pixel SR having the luminance value Rp') although the luminance value Rx' is 0, an image (shape) different from the image to be displayed may be displayed. For this reason, if the luminance value Rx' is 0, the luminance value Ry' is not 0, and the luminance value Rz' is 0, the value obtained by multiplying the luminance value Ry' by 0.5 is added to luminance value Rp" of sub-pixel SR of a next row in the pixel array. In other words, the value (luminance value) obtained by multiplying the luminance value Ry' by 0.5 is moved to a sub-pixel SR of a next row in the case illustrated in FIG. 11.

Figure 9:
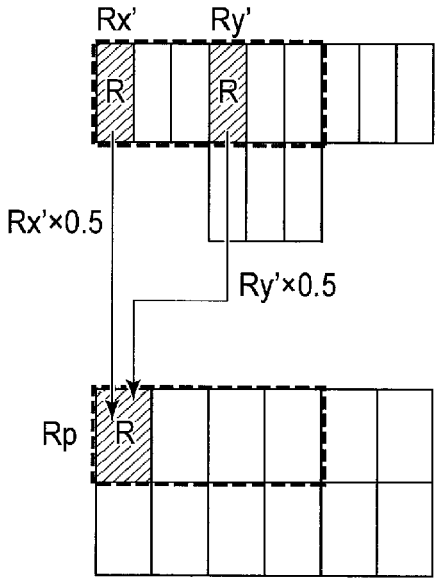
FIG. 9 is a diagram illustrating a sub-pixel to which the luminance value computed from a color component extracted from a first RGB image signal and a color component extracted from a second RGB image signal is allocated.
Figure 10:
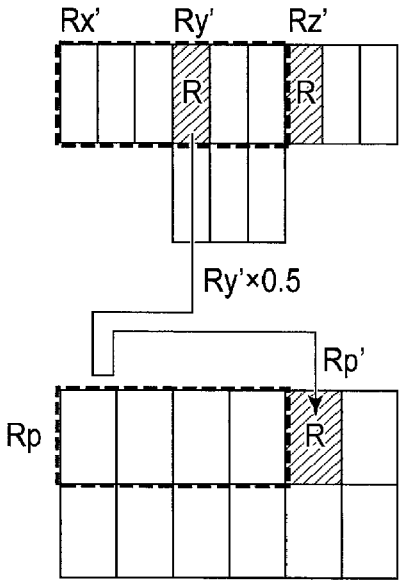
FIG. 10 is a diagram illustrating a sub-pixel to which the luminance value computed from a color component extracted from a first RGB image signal and a color component extracted from a second RGB image signal is allocated.
Figure 11:
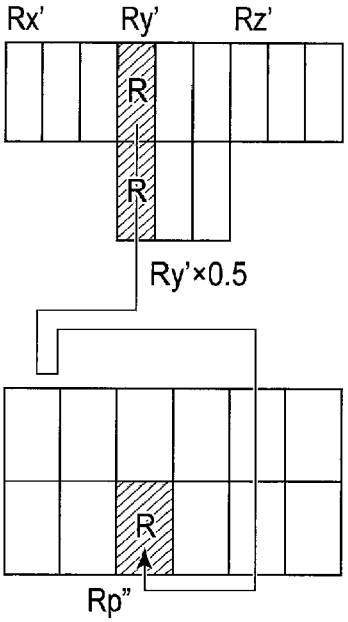
FIG. 11 is a diagram illustrating a sub-pixel to which the luminance value computed from a color component extracted from a first RGB image signal and a color component extracted from a second RGB image signal is allocated.
Figure 12:
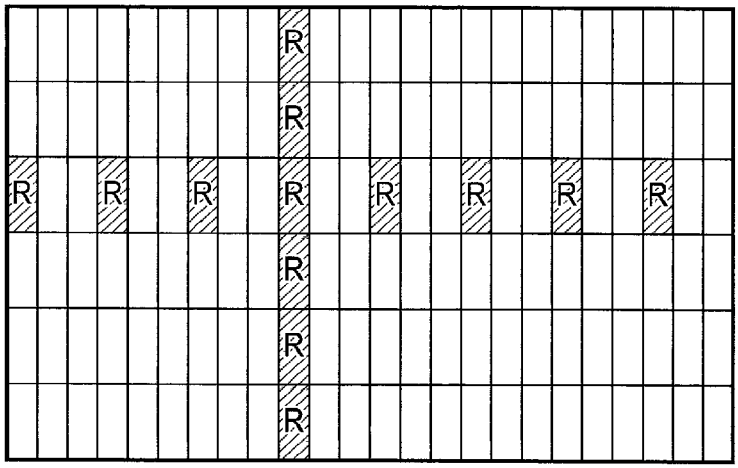
FIG. 12 is a diagram specifically illustrating a sub-pixel to which the luminance value computed from a color component extracted from a first RGB image signal and a color component extracted from a second RGB image signal is allocated.
Figure 13:
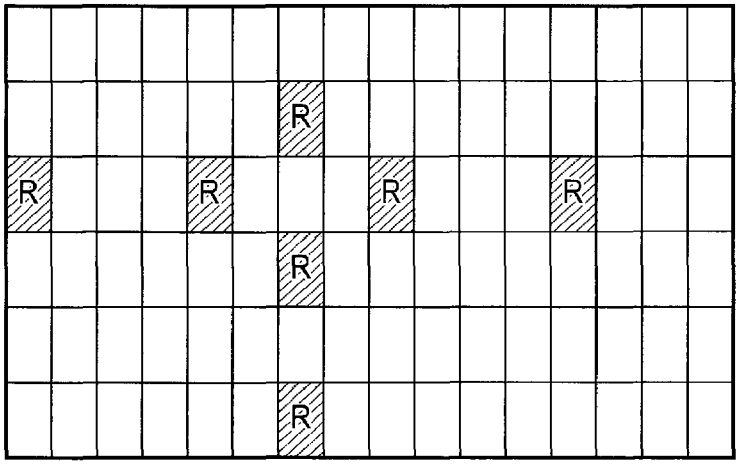
FIG. 13 is a diagram specifically illustrating a sub-pixel to which the luminance value computed from a color component extracted from a first RGB image signal and a color component extracted from a second RGB image signal is allocated.

As a concrete example, according to the processing illustrated in FIG. 9 to FIG. 11, for example, the luminance value of the sub-pixel SR included in the color components extracted from the RGB image signal represented by hatching in FIG. 12 is added as the luminance value of each sub-pixel SR in the RGBW image signal represented by hatching in FIG. 13 (i.e., allocated to each of the sub-pixels SR).

In the present embodiment, variation of the image accompanying the conversion can be suppressed by allocating the brightness computed in step S12 to the sub-pixels in the RGBW image signal as illustrated in FIG. 9 to FIG. 11.

For example, conversion of the RGB image signal to display an image including a white frame (white line) along the outer periphery of the display area DA into the RGBW image signal will be explained here.

Figure 14:
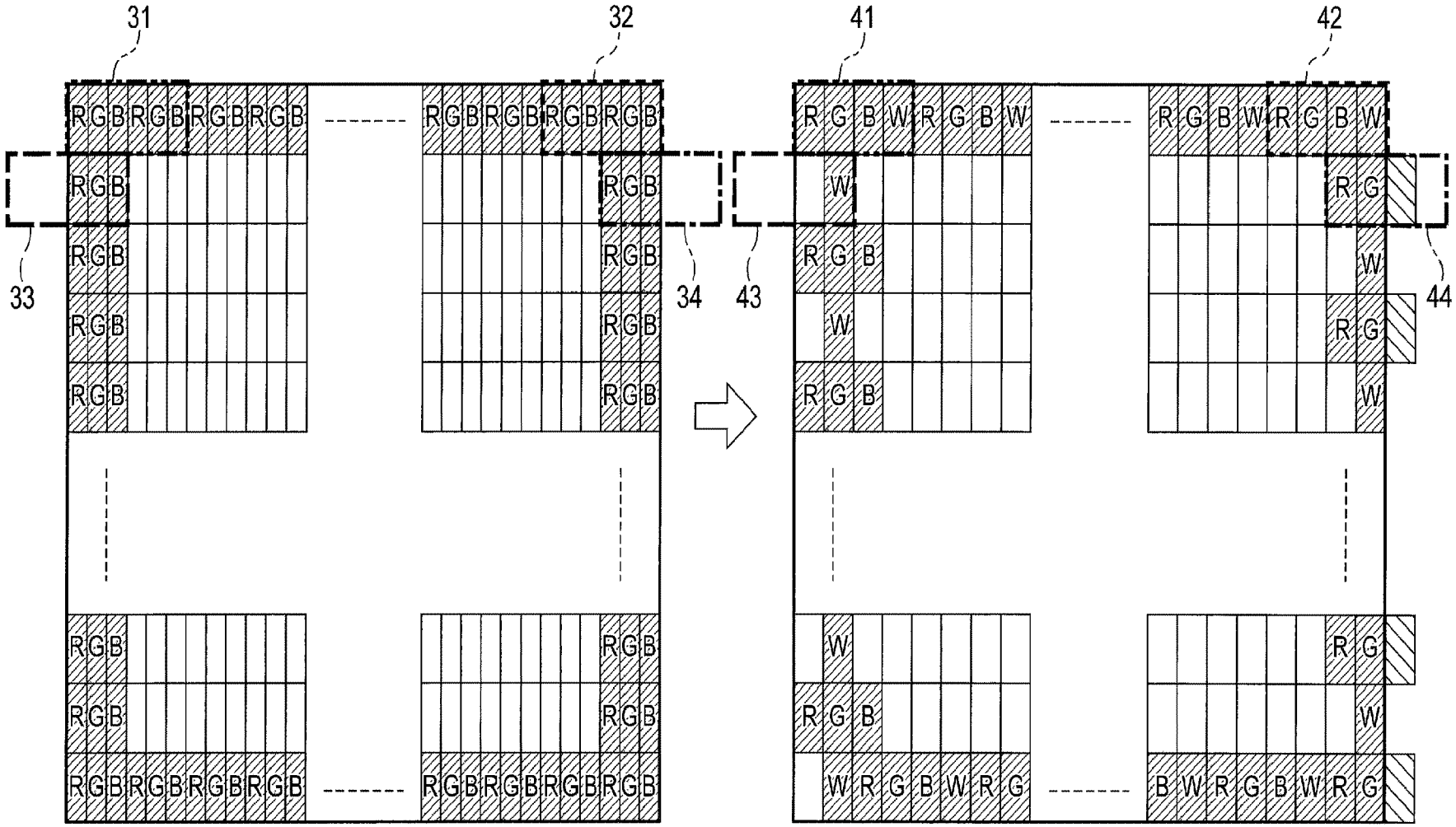
FIG. 14 is a diagram illustrating correspondence of the RGB image signal to the RGBW image signal into which the RGB image signal is converted by the conversion.

FIG. 14 illustrates correspondence of the RGB image signal to display an image including a white frame along the outer periphery of the display area DA to the RGBW image signal into which the RGB image signal is converted by the conversion.

In FIG. 14, hatched blocks represent the sub-pixels outputting the light (i.e., having the luminance value which is not 0), and characters (R, G, B, and W) in the blocks represent the colors (i.e., sub-pixels SR, SG, SB, and SW) of light output from the sub-pixels.

As illustrated in FIG. 14, if the conversion is executed for RGB image signals 31 for two pixels corresponding to the start end (left end) of the first row of the pixel array, the RGB image signals 31 are converted into an RGBW image signal 41. Similarly, if the conversion is executed for the RGB image signals 32 for two pixels corresponding to the terminal end (right end) of the first row of the pixel array, the RGB image signals 32 are converted into an RGBW image signal 42. The RGB image signals 31 and 32 have been explained here, and the conversion is also executed similarly for the other RGB image signals arranged between the RGB image signals 31 and 32 in the row direction. In addition, the first row of the pixel array has been explained, and the processing is also executed for the other odd-numbered rows.

According to the pixel array in the present embodiment, the pixels PX of odd-numbered rows and the pixels PX of even-numbered rows are arranged to be shifted by half pixel in the row direction.

In such a pixel array, for example, not the sub-pixel SR, but the sub-pixel SB is arranged at the start end of the second row of the pixel array. If the same processing as that for the odd-numbered rows (for example, the first row) is executed for the second row of the pixel array, the luminance value of the sub-pixel SR is allocated to the start end of the second row and the RGBW image signal corresponding to the pixel array in the present embodiment cannot be obtained. In the present embodiment, since the output is arranged in order of RGBW, the white component can be reproduced by the left RGB image signal (first RGB image signal) and the image quality is good. In contrast, for example, the output can be processed in order of BWRG but, undesirably, W is interposed between B and R (i.e., barycenter is displaced) when the white component is reproduced by B, R, and G.

For this reason, in the second row of the pixel array, as illustrated in FIG. 14, the conversion is executed for RGB image signals 33 for two pixels, i.e., the first RGB image signal including 0 as the luminance values of the sub-pixels SR, SG, and SB and the second RGB image signal including the luminance values of the sub-pixels SR, SG, and SB corresponding to the white frame, and the RGB image signal 33 is thereby converted into an RGBW image signal 43. According to this, the luminance values of the sub-pixels SB and SW included in the RGBW image signal 43 can be used as the luminance values of the sub-pixels SB and SW arranged at the start end of the second row of the pixel array.

After that, the processing of converting the RGB image signal for two pixels into the RGBW image signal for one pixel is executed sequentially, but the RGB image signal for one pixel needs to be converted into the RGBW image signal by the above-described pixel array, at the terminal end of the second row of the pixel array.

In this case, as illustrated in FIG. 14, the conversion is executed for the RGB image signals 34 for two pixels, i.e., the first RGB image signal including the luminance values of the sub-pixels SR, SG, and SB corresponding to the white frame (i.e., the RGB image signal for one pixel corresponding to the terminal end of the second row) and the second RGB image signal including 0 as the luminance values of the sub-pixels SR, SG, and SB, and the RGB image signal 34 is thereby converted into the RGBW image signal 44. According to this, the luminance values of the sub-pixels SR and SG included in the RGBW image signal 44 can be used as the luminance values of the sub-pixels SR and SG arranged at the terminal end of the second row of the pixel array.

Incidentally, white color to be reproduced based on the luminance values of the sub-pixels SR, SG, and SB of the second RGB image signal included in the RGB image signal 33 illustrated in FIG. 14 can be reproduced by the light output based on the luminance value of the sub-pixel SW included in the RGBW image signal 43.

In contrast, white color to be reproduced based on the luminance values of the sub-pixels SR, SG, and SB of the first RGB image signal included in the RGB image signal 34 illustrated in FIG. 14 needs be reproduced by the light output based on the luminance values of the sub-pixels SR, SG, and SB included in the RGBW image signal 44.

In the pixel array of the present embodiment, however, the sub-pixel arranged at the terminal end of the second row is the sub-pixel SG, and the light output from the sub-pixel SB cannot be used.

For this reason, yellowish color lacking the blue component is visually recognized at the terminal parts of the even-numbered rows including the second row of the pixel array, and degradation in image quality is thereby caused.

Thus, in the present embodiment, the luminance value of the sub-pixel SB in the RGBW image signal is varied (adjusted) based on the luminance value of the sub-pixel SB included in the RGB image signal, which cannot be represented in the display panel 11 (i.e., pixels PX) by the conversion.

Figure 15:
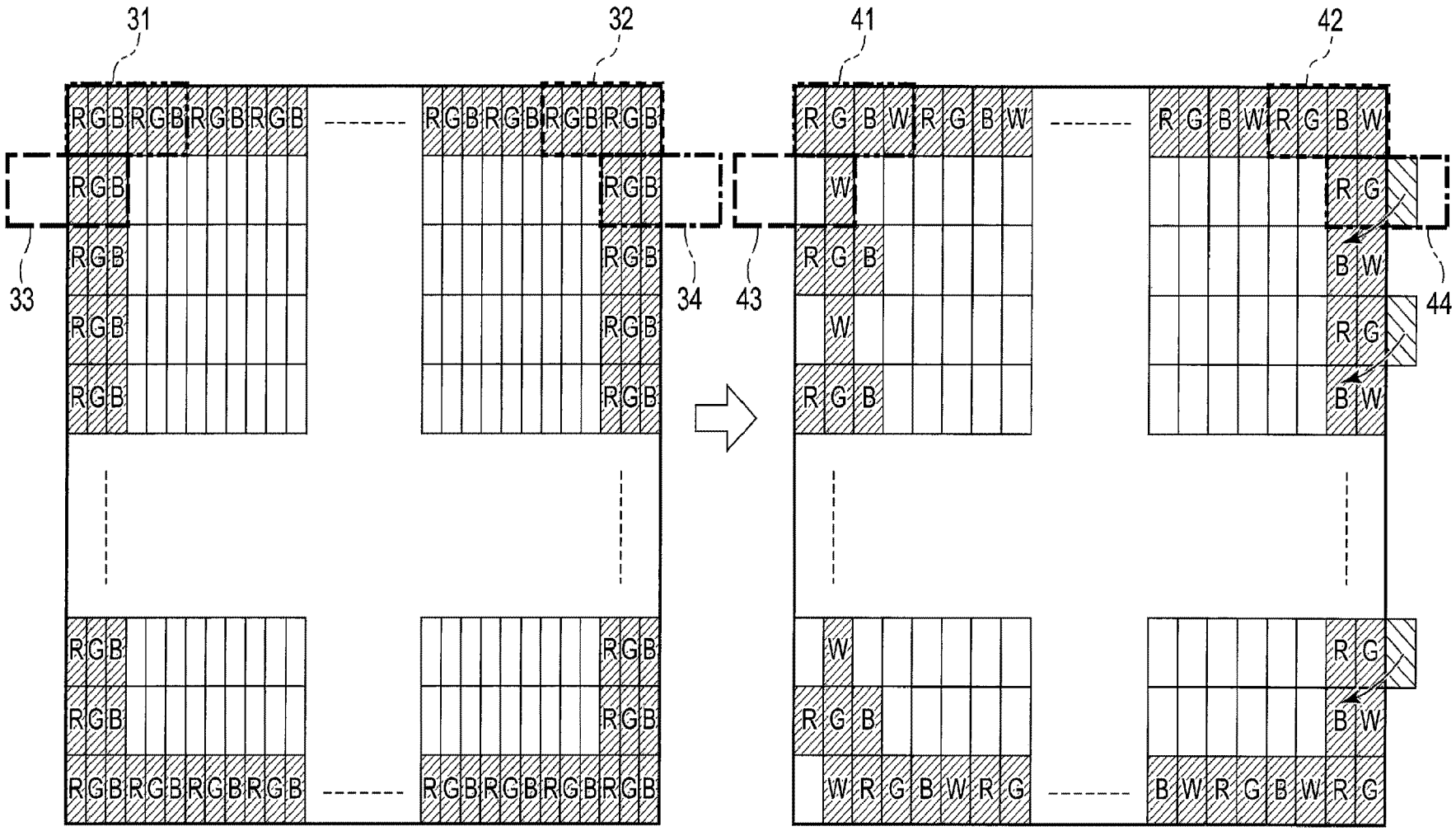
FIG. 15 is a conceptual diagram illustrating variation of the luminance value of the sub-pixels in the rendering.

More specifically, as illustrated in FIG. 15, the luminance value (level) of the sub-pixel SB included in the RGBW image signal 44 into which the RGB image signal 34 is converted is added to the luminance value of the sub-pixel SB included in the pixel PX arranged at the terminal end of the next row (i.e., third row).

In the present embodiment, white color can be reproduced with the luminance values of the sub-pixels SR, SG, and SB included in the RGBW image signal 44 by this processing.

The processing for the second row of the pixel array has been mainly described but the processing for the other even-numbered rows is the same as this. In the last row of the even-numbered rows of the pixel array, this processing does not need to be executed since a next row does not exist. In addition, the luminance value of the sub-pixel SB, which cannot be represented in the last row, can be added to the luminance value of the sub-pixel SB of an upper row.

A concrete example of an algorithm of the rendering executed in the present embodiment will be explained with reference to FIG. 16.

First, conversion (rendering) is executed for the RGB image signals corresponding to the first row of the pixel array (step S21). In this case, the panel driver 113 sequentially converts the image signals from the RGB image signal corresponding to the start end of the pixel array (i.e., left side). In the first row of the pixel array, the processing of converting the RGB image signals for two pixels into the RGBW image signal for one pixel is executed from the start end to the terminal end, in the same manner.

Next, conversion is executed for the RGB image signals corresponding to the second row of the pixel array (step S22). In this case, the panel driver 113 sequentially converts the image signals from the RGB image signal corresponding to the start end of the pixel array.

Figure 16:
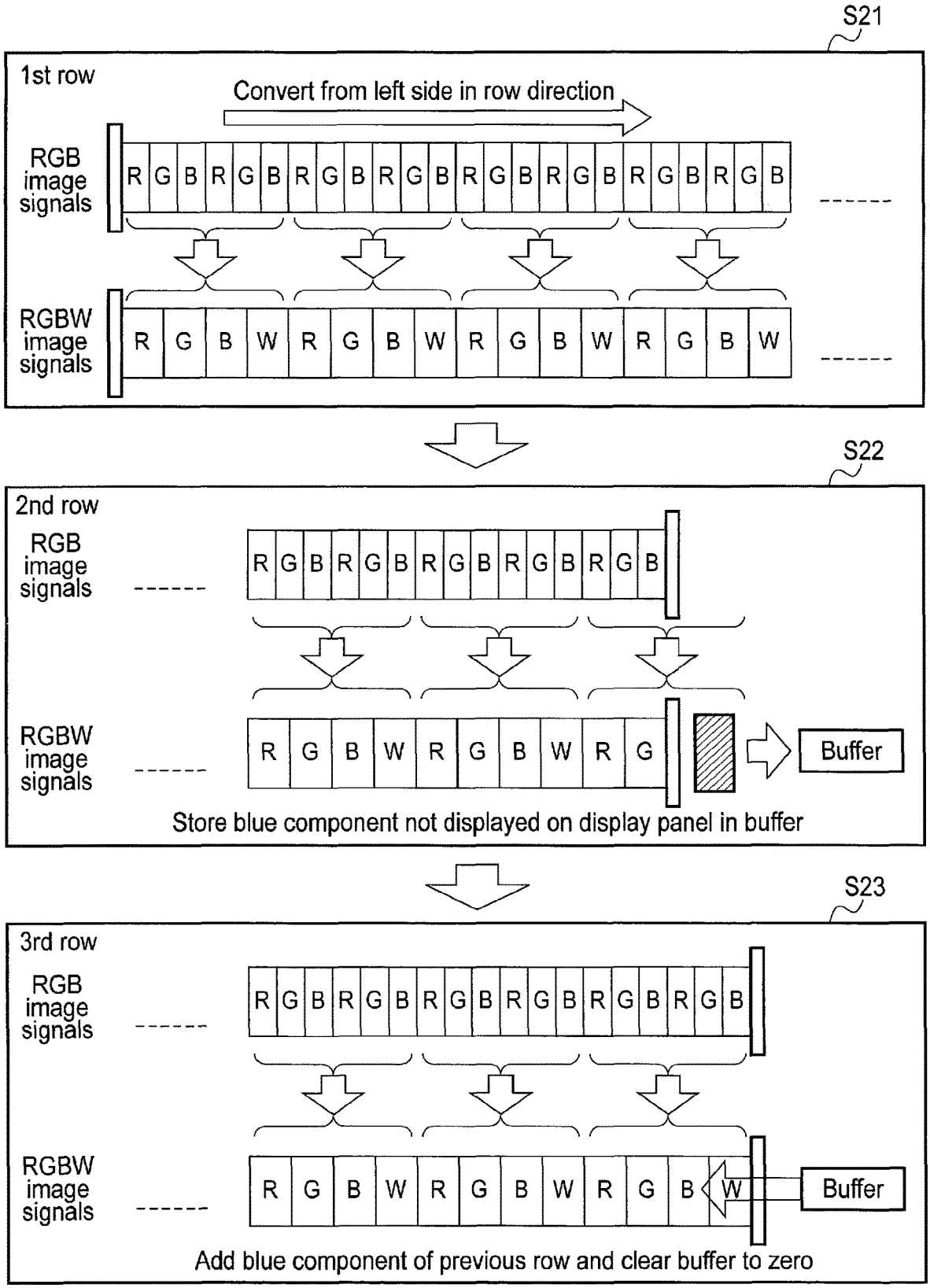
FIG. 16 is a diagram illustrating a concrete example of an algorithm of the rendering.

If the conversion is executed for the RGB image signals corresponding to the second row of the pixel array as described with reference to FIG. 14, the RGB image signal for one pixel corresponding to the terminal end of the pixel array is left as illustrated in FIG. 16. In this case, the RGB image signal for one pixel corresponding to the terminal end of the second row of the pixel array, which is left without being converted as described above, is regarded as the first RGB image signal, the RGB image signal in which the luminance values of the sub-pixels SR, SG, and SB are 0 is regarded as the second RGB image signal, and the conversion is executed for the RGB image signals for two pixels, i.e., the first RGB image signal and the second RGB image signal.

The RGBW image signal into which the first RGB image signal and the second RGB image signal are converted by the conversion includes the luminance values of the sub-pixels SR, SG, SB, and SW, and the luminance values of the sub-pixels SR and SG are used as the luminance values of the sub-pixels SR and SG included in the RGBW image signal located at the terminal end of the pixel array.

In contrast, for example, the luminance value of the sub-pixel SB included in the RGBW image signal (i.e., the blue component not displayed on the display panel 11) is stored in the buffer in the panel driver 113. According to the conversion illustrated in FIG. 6, the luminance value of the sub-pixel SB stored in the buffer corresponds to the luminance value of the sub-pixel SB included in the RGB image signal for one pixel corresponding to the terminal end of the second row of the pixel array.

Since the luminance value of the sub-pixel SW included in the RGBW image signal is 0, the sub-pixel may be abandoned.

Next, conversion is executed for the RGB image signals corresponding to the third row of the pixel array (step S23). In this case, the panel driver 113 sequentially converts the image signals from the RGB image signal corresponding to the start end of the pixel array.

When the conversion is finished for the RGB image signal corresponding to the terminal end of the third row of the pixel array, the panel driver 113 adds the luminance value stored in the buffer (i.e., the blue component of the previous row) to the luminance value of the sub-pixel SB included in the pixel PX arranged at the terminal end of the third row of the pixel array. In this case, the luminance value stored in the buffer is cleared.

If the luminance value of the sub-pixel SB exceeds the maximum value as a result of adding the luminance value stored in the buffer to the luminance value of the sub-pixel SB, the luminance value of the sub-pixel SB is assumed to be the maximum value. In this case, the luminance value of the extent exceeding the maximum value may be further added to the luminance value of the other sub-pixel SB.

The processing of the first to third rows of the pixel array has been explained, and the even-numbered rows following the fourth row are subjected to the same processing as that in step S22 and the odd-numbered rows following the fifth row are subjected to the same processing as that in step S23. When the processing is executed in the last row of the pixel array, the rendering is finished.

In such rendering, the RGBW image signal to allow the blue component (i.e., a pixel value of the sub-pixel SB) which is not displayed on the display panel 11 by the conversion for converting the RGB image signal into the RGBW image signal to be represented by the sub-pixel SB of the next row can be obtained. When the rendering is finished, the images are displayed on the display panel 11 based on the RGBW image signal obtained by the rendering.

In the present embodiment, as described above, the pixels PX (first pixels) constituting an odd-numbered row (first row) and the pixels PX (second pixels) of an even-numbered row (second row), in the pixel array, are arranged such that the sub-pixels SR (first sub-pixels) included in the pixels PX of the odd-numbered row are adjacent to the sub-pixels SB (third sub-pixels) included in the pixels PX of the even-numbered row in the columnar direction. In addition, in the present embodiment, the conversion of converting the input RGB image signal (first image signal) into the RGBW image signal (second image signal) is executed. Furthermore, in the present embodiment, the luminance value of the sub-pixel SB in the RGBW image signal is varied, based on the luminance value of the sub-pixel SB included in the RGB image signal, which cannot be represented in the display panel 11 due to the pixel array when the conversion is executed.

In the present embodiment, with such a configuration, the luminance value of the sub-pixel SB, which cannot be represented in the display panel 11 (pixels PX) by the conversion, can be represented in the display panel 11, and the degradation in image quality accompanying the conversion can be thereby suppressed.

In the pixel array of the present embodiment, the sub-pixels SR are arranged at start ends of the odd-numbered rows while the sub-pixels SW are arranged at terminal ends of the odd-numbered rows. In addition, the sub-pixels SB are arranged at start ends of the even-numbered rows while the sub-pixels SG are arranged at terminal ends of the even-numbered rows. Furthermore, the luminance value of the sub-pixel SB which cannot be represented in the display panel 11 due to the pixel array when the conversion is executed in the present embodiment implies the luminance value which is to be represented in the sub-pixel SB next (adjacent) to the sub-pixel SG arranged at the terminal end of the even-numbered row. In the present embodiment, such a luminance value is added to the luminance value of the sub-pixel SB included in the pixel PX arranged at the terminal end of the next odd-numbered row. According to this, the luminance value of the sub-pixel SB, which cannot be represented in the display panel 11 (pixels PX) by the conversion, can be represented with the pixels at appropriate positions.

In each pixel PX of the present embodiment, the sub-pixel SR outputting the light corresponding to the red wavelength band, the sub-pixel SG outputting the light corresponding to the green wavelength band, the sub-pixel SB outputting the light corresponding to the blue wavelength band, and the sub-pixel SW outputting the light corresponding to the white wavelength band are arrayed in the row direction of the pixel array from the left side but, for example, the sub-pixels may be arrayed in inverse order. That is, in the pixel PX, the sub-pixels SR, SG, SB, and SW may be arrayed in the row direction of the pixel array from the right side.

In the following explanations, the sub-pixels SR, SG, SB, and SW are arrayed in the row direction of the pixel array from the right side.

Figure 17:
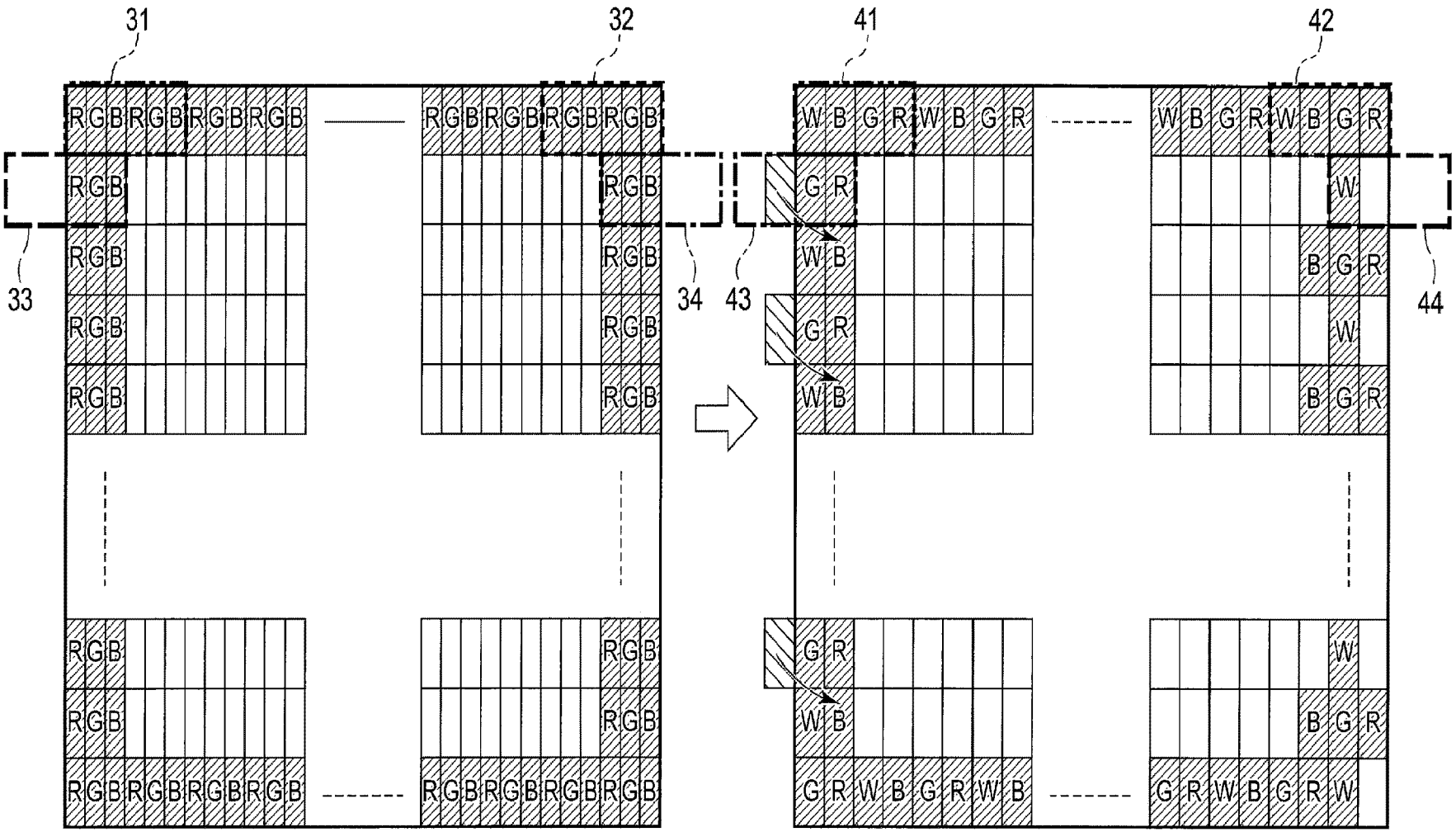
FIG. 17 is a diagram illustrating the rendering executed in a case where the sub-pixels included in the pixel are arranged in inverse order.

FIG. 17 illustrates, for example, correspondence of the RGB image signal to display an image including a white frame along the outer periphery of the display area DA to the RGBW image signal obtained by executing the rendering of the RGB image signal, as described above.

In FIG. 17, similarly to FIG. 14, hatched blocks represent the sub-pixels outputting the light (i.e., having the luminance value which is not 0), and characters (R, G, B, and W) in the blocks represent the colors (i.e., sub-pixels SR, SG, SB, and SW) of light output from the sub-pixels.

If the sub-pixels SR, SG, SB, and SW are arrayed in the row direction from the right side, in the pixel array (pixels PX), the array of the sub-pixels SR, SG, SB, and SW in which the luminance value included in the RGBW image signal after executing the conversion for the RGB image signal is not 0 is an inverse of the array illustrated in FIG. 14 with respect to the columnar direction of the pixel array used as an axis.

For this reason, if the sub-pixels SR, SG, SB, and SW are arrayed in the row direction from the right side, the degradation in image quality can be suppressed similarly to the case where the sub-pixels SR, SG, SB, and SW are arrayed in the row direction from the left side, by executing the above-described rendering illustrated in FIG. 16 with the right end of each row of the pixel array referred to as the start end and the left end of each row of the pixel array referred to as the terminal end.

In the present embodiment, the display panel 11 includes the pixel array illustrated in FIG. 3, but the pixel array is a mere example and, for example, the odd-numbered rows and the even-numbered rows in the pixel array explained in the present embodiment may be replaced. In addition, the row direction or columnar direction of the pixel array explained in the present embodiment may be different. Furthermore, the other pixel array may be employed, if it enables the luminance value of the sub-pixel which cannot be represented in the display panel 11 due to the pixel array to be represented in the display panel 11 in a case where the conversion of converting the RGB image signal into the RGBW image signal is executed as described above.

In addition, in the present embodiment, the lightness can be improved by displaying images on the display panel 11 where the pixels PX including the sub-pixels SR, SG, SB, and SW are arrayed, as compared with a case of displaying images on the display panel where the pixels including the sub-pixels SR, SG, and SB are arrayed but, to further reduce the power consumption of the backlight unit 12, illumination strength of the backlight unit 12 may be dynamically varied in accordance with images (contents) and the like displayed on the display panel 11.

Second Embodiment

Next, a second embodiment will be explained. A configuration and the like of a display device according to the present embodiment is the same as those of the above-described first embodiment, and will be arbitrarily described with reference to FIG. 1, FIG. 2, and the like.

In addition, a display device 10 of the present embodiment is the same as the above-described first embodiment in terms of inputting the above-described RGB image signal and displaying images on a display panel 11 where pixels PX including sub-pixels SR, SG, SB, and SW are arrayed, based on the RGB image signal.

That is, the display device 10 according to the present embodiment executes processing of converting an RGB image signal into an RGBW image signal and displaying images, similarly to the display device of the above-described first embodiment.

The RGB image signal to display an image including a white frame along the outer periphery of the display area DA is converted into the RGBW image signal in the above-described first embodiment but, in the present embodiment, it is assumed that the RGB image signal to display an image including a blue frame (blue line) along the outer periphery of the display area DA is converted into the RGBW image signal.

Figure 18:
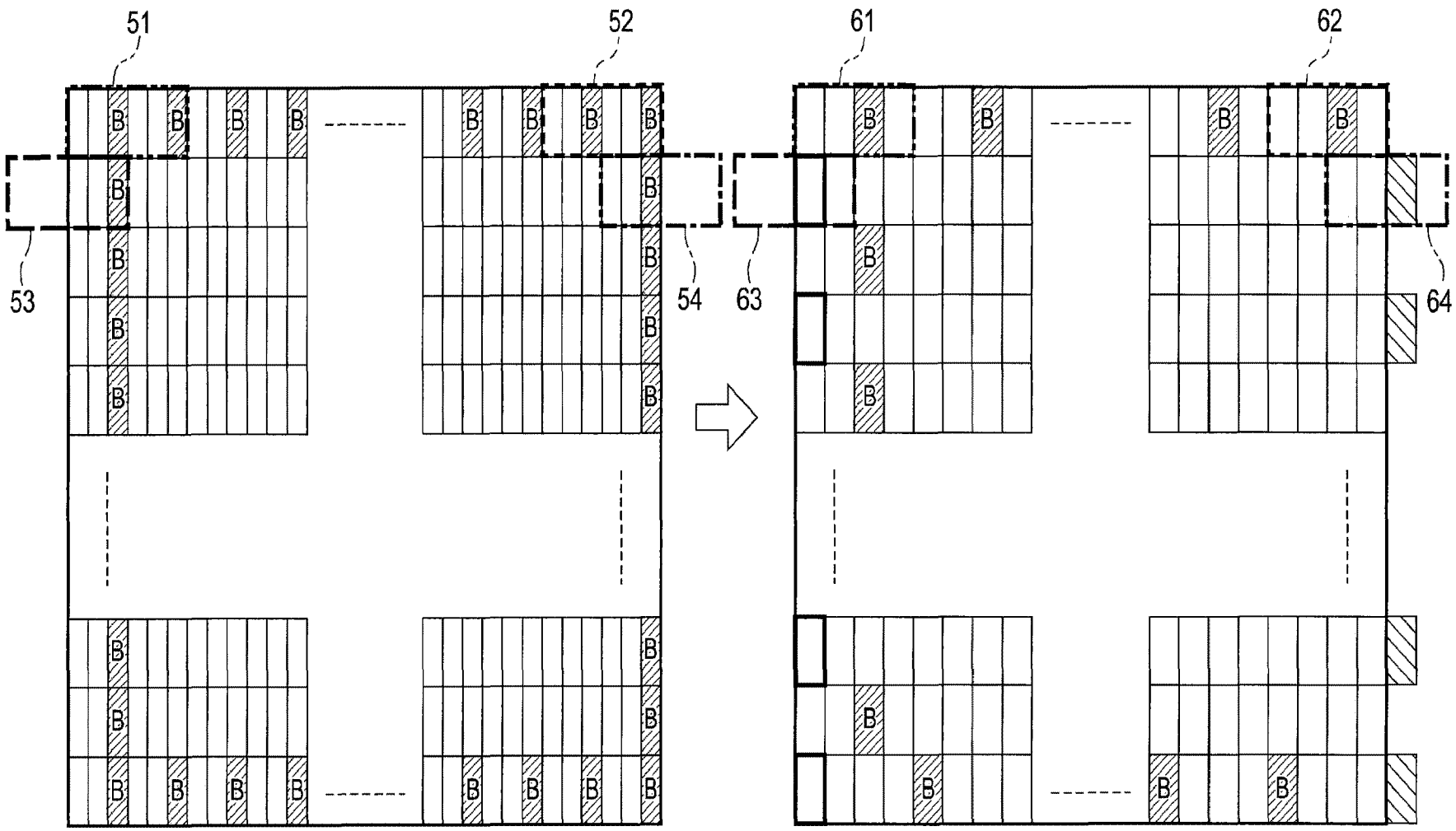
FIG. 18 is a diagram illustrating correspondence of the RGB image signal to the RGBW image signal into which the RGB image signal is converted by the conversion, in the second embodiment.

FIG. 18 illustrates correspondence of the RGB image signal to display an image including a blue frame along the outer periphery of the display area DA to the RGBW image signal into which the RGB image signal is converted by the conversion.

In FIG. 18, hatched blocks referred to as "B" represent sub-pixels SB outputting blue light (i.e., having the luminance value which is not 0).

As illustrated in FIG. 18, if the conversion is executed for RGB image signals 51 for two pixels, the RGB image signals 51 are converted into RGB image signals 61. Similarly, if the conversion is executed for RGB image signals 52 for two pixels, the RGB image signals 52 are converted into RGB image signals 62. In the RGB image signals 51 and 52, the luminance value of the sub-pixels SR and the luminance value of the sub-pixels SG are 0.

The RGB image signals 51 and 52 have been explained here, and the conversion is also executed similarly for the other RGB image signals arranged between the RGB image signals 51 and 52 in the row direction. In addition, the first row of the pixel array has been explained, and the processing is also executed for the other odd-numbered rows.

As described above, according to the pixel array in the present embodiment, the pixels PX of odd-numbered rows and the pixels PX of even-numbered rows are arranged to be shifted by half pixel in the row direction.

In such a pixel array, for example, not the sub-pixel SR, but the sub-pixel SB is arranged at the start end (left end) of the second row of the pixel array. If the same processing as that for the odd-numbered rows (for example, the first row) is executed for the second row of the pixel array, the luminance value of the sub-pixel SR is allocated to the start end of the second row and the RGBW image signal corresponding to the pixel array in the present embodiment cannot be obtained.

For this reason, in the second row of the pixel array, as illustrated in FIG. 18, the conversion is executed for RGB image signals 53 for two pixels, i.e., the first RGB image signal including 0 as the luminance values of the sub-pixels SR, SG, and SB and the second RGB image signal including the luminance value of the sub-pixel SB corresponding to the blue frame, and the RGB image signal 53 is thereby converted into an RGBW image signal 63. According to this, the luminance values of the sub-pixels SB and SW included in the RGB image signal 63 can be used as the luminance values of the sub-pixels SB and SW arranged at the start end of the second row of the pixel array.

The processing described with reference to FIG. 11 is executed in the conversion for the RGB image signal 53 though the details are omitted. For this reason, the luminance value of the sub-pixel SB included in the second RGB image signal of the RGB image signal 53 is not allocated to the sub-pixel SB arranged at the start end of the second row of the pixel array, but is added to the luminance value of the sub-pixel SB included in the pixel PX arranged at the start end of the third row that is the next row.

In this case, since blue color is to be displayed (output) in the second row of the pixel array but is not displayed, the displayed image may be visually recognized as an image different from an image to be displayed based on the RGB image signal and the degradation in image quality may be caused.

Thus, the luminance value of the sub-pixel SB included in the RGB image signal 53 (second RGB image signal) corresponding to the start end of the second row, which is to be reproduced by the sub-pixel SB included in the pixel PX arranged at the start end of the third row by the conversion, is represented by not the sub-pixel SB of the third row, but the sub-pixel SB included in the pixel PX arranged at the start end of the second row.

Figure 19:
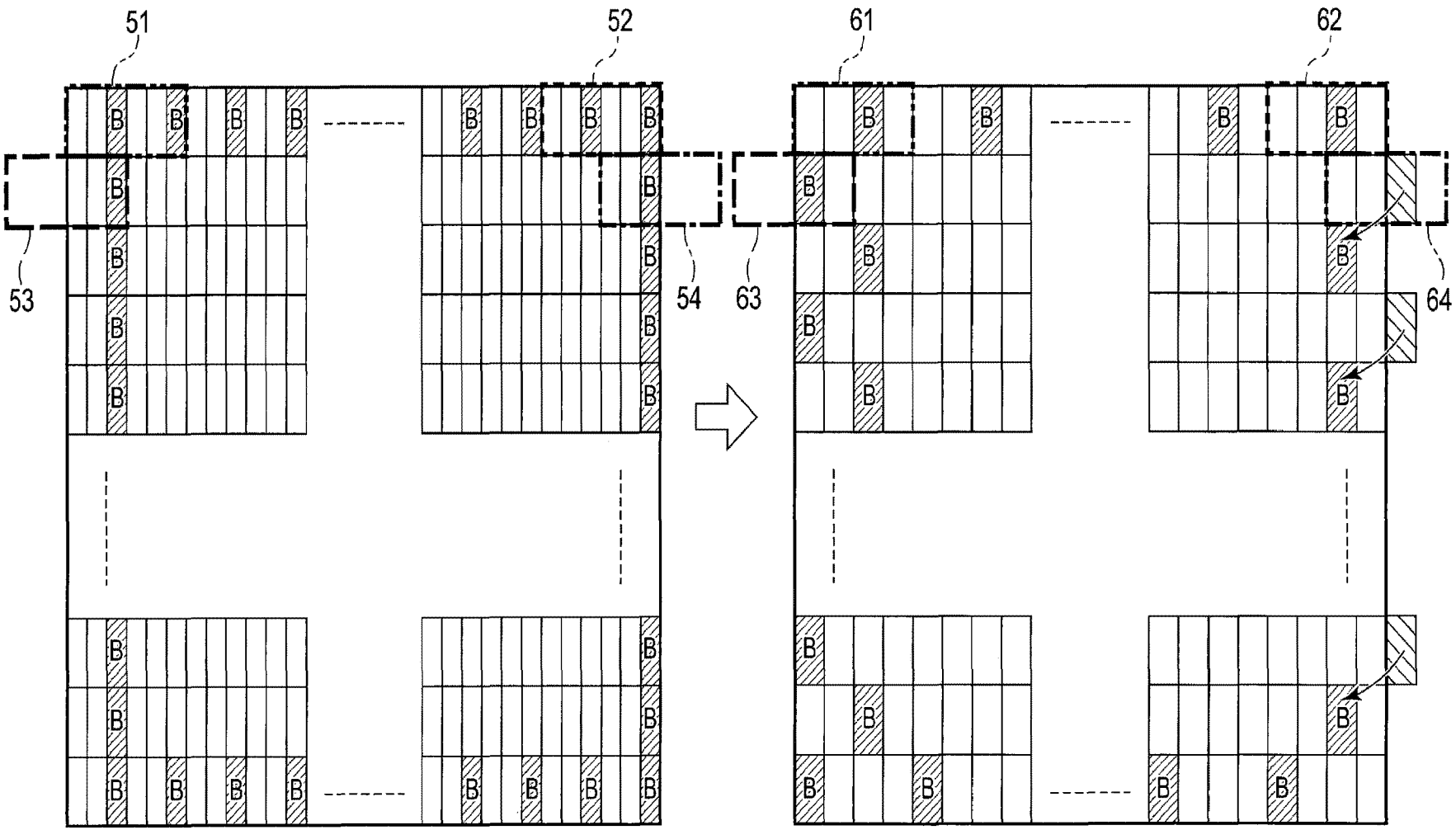
FIG. 19 is a conceptual diagram illustrating variation of the luminance value of the sub-pixels in the rendering.

According to this, the light based on the luminance value of the sub-pixel SB included in the second RGB image signal of the RGB image signal 53 corresponding to the second row of the pixel array can be output in the sub-pixel SB included in the pixel PX arranged at the start end of the second row, as illustrated in FIG. 19.

The processing for the second row of the pixel array has been mainly described but the processing for the other even-numbered rows is the same as this.

In the pixel PX arranged at the terminal end of the second row, the light output from the sub-pixel SB becomes unable to be used as explained in the above-described first embodiment. In other words, the same processing as that of the above-described first embodiment is executed in the conversion of the RGB image signal 54 into the RGBW image signal 64 as illustrated in FIG. 18.

A concrete example of an algorithm of the rendering executed in the present embodiment will be explained with reference to FIG. 20.

First, conversion (rendering) is executed for the RGB image signals corresponding to the first row of the pixel array (step S31). In this case, the panel driver 113 sequentially converts the image signals from the RGB image signal corresponding to the start end of the pixel array (i.e., left side). In the first row of the pixel array, the processing of converting the RGB image signals for two pixels into the RGBW image signal for one pixel is executed from the start end to the terminal end, in the same manner.

Next, conversion is executed for the RGB image signals corresponding to the second row of the pixel array (step S32). In this case, the panel driver 113 sequentially converts the image signals from the RGB image signal corresponding to the start end of the pixel array.

Figure 20:
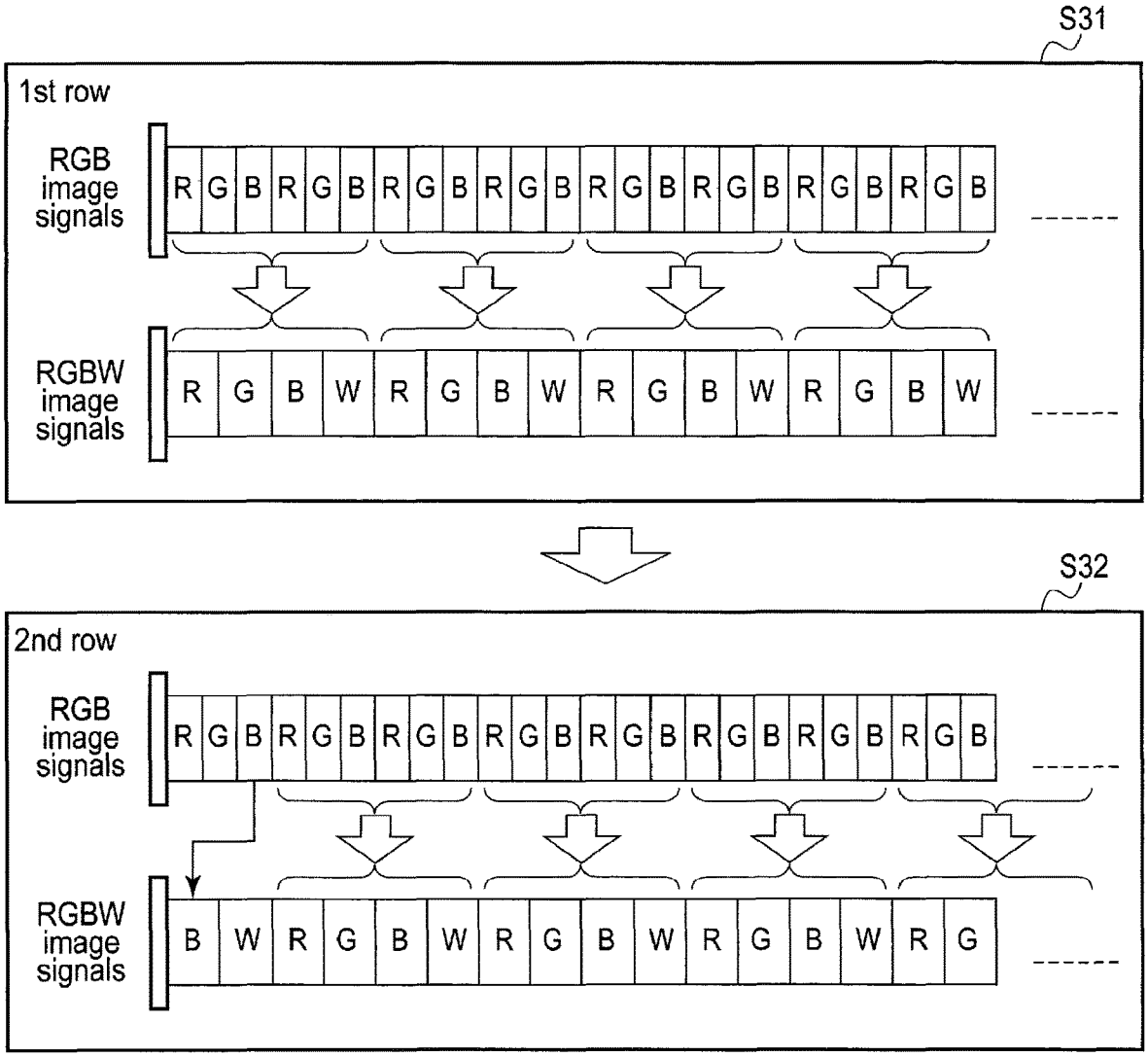
FIG. 20 is a diagram illustrating a concrete example of an algorithm of the rendering.

As illustrated in FIG. 20, the luminance values of the sub-pixels SB and SW included in the RGBW image signal need to be obtained from the RGB image signal for one pixel, at the start end of the second row of the pixel array. In this case, the luminance value of the sub-pixel SB included in the RGB image signal for one pixel corresponding to the start end of the second row of the pixel array is used as the luminance value of the sub-pixel SB included in the RGBW image signal. In contrast, the luminance value of the sub-pixel SW included in the RGBW image signal can be obtained by using the RGB image signal in which the luminance values of the sub-pixels SR, SG, and SB are 0 as the first RGB image signal, using the RGB image signal for one pixel corresponding to the start end of the second row of the pixel array as the second image signal, and executing the conversion for the RGB image signals for two pixels, i.e., the first RGB image signal and the second RGB image signal. When the image including the blue frame is displayed as described above, the obtained luminance value of the sub-pixel SW is 0.

When the conversion of the RGB image signal for one pixel corresponding to the start end of the second row of the pixel array is finished, the conversion is sequentially executed for the following RGB image signals arranged in the row direction.

The processing of the first and second rows of the pixel array has been explained, and the odd-numbered rows following the third row are subjected to the same processing as that in step S31 and the even-numbered rows following the fourth row are subjected to the same processing as that in step S32. When the processing is executed in the last row of the pixel array, the rendering is finished.

In the rendering, the RGBW image signal to allow the blue component (i.e., a pixel value of the sub-pixel SB included in the RGB image signal corresponding to the start end of the even-numbered row) which is not displayed on the display panel 11 by the conversion for converting the RGB image signal into the RGBW image signal to be represented by the sub-pixel SB of the even-numbered row can be obtained. When the rendering is finished, the images are displayed on the display panel 11 based on the RGBW image signal obtained by the rendering.

The same processing as that explained in the above-described first embodiment is executed at the terminal end of each row of the pixel array though not illustrated in FIG. 20.

In the present embodiment, as described above, the luminance value of the sub-pixel SB included in the RGB image signal (first image signal) corresponding to the start end of the even-numbered row (for example, second row), which is to be represented by the sub-pixel SB (third sub-pixel) included in the pixel PX arranged at the start end of the odd-numbered row (for example, third row) by the conversion, is added to the luminance value of the sub-pixel SB arranged at the start end of this even-numbered row.

More specifically, for example, when an image including the blue frame (blue line) along the outer periphery of the display area DA is displayed, the luminance value of the sub-pixel SB included in the RGB image signal corresponding to the start end of the even-numbered row is allocated to the sub-pixel SB included in the pixel PX arranged at the start end of the odd-numbered row under this even-numbered row by executing the conversion (processing illustrated in FIG. 11).

However, in the present embodiment, having the above-described configuration, the luminance value of the sub-pixel SB included in the RGB image signal corresponding to the start end of the even-numbered row can be represented by the sub-pixel SB included in the pixel PX arranged at the start end of this even-numbered row.

Thus, in the present embodiment, an image having little difference from the image to be displayed by the input RGB image signal can be displayed and the degradation in image quality can be suppressed.

The sub-pixels SR, SG, SB, and SW are arrayed in the row direction of the pixel array from the left side, in each pixel PX of the present embodiment but, for example, the sub-pixels may be arrayed in inverse order. That is, in the pixel PX, the sub-pixels SR, SG, SB, and SW may be arrayed in the row direction of the pixel array from the right side.

In the following explanations, the sub-pixels SR, SG, SB, and SW are arrayed in the row direction of the pixel array from the right side.

Figure 21:
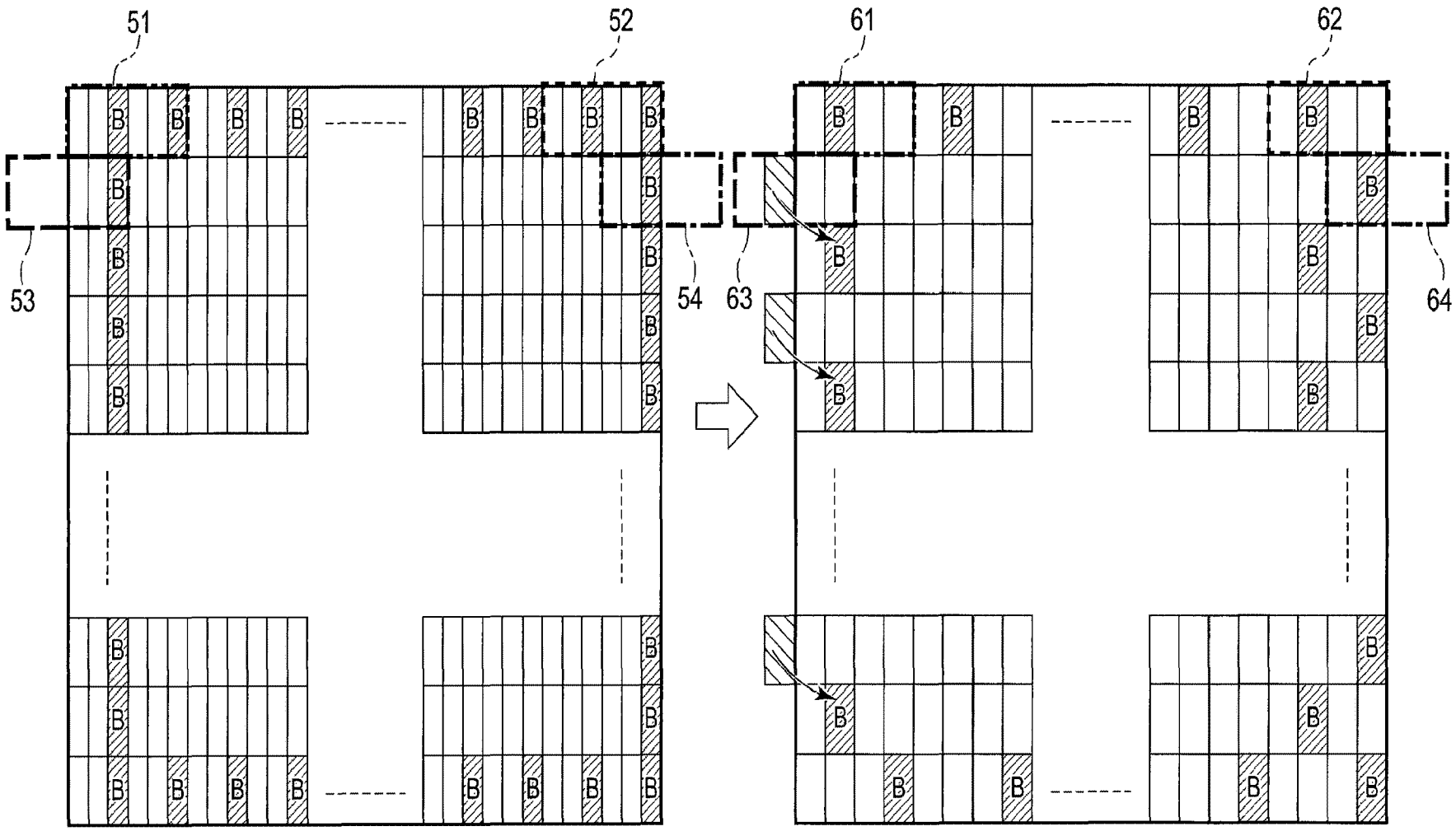
FIG. 21 is a diagram illustrating the rendering executed in a case where the sub-pixels included in the pixel are arranged in inverse order.

FIG. 21 illustrates, for example, correspondence of the RGB image signal to display an image including a blue frame along the outer periphery of the display area DA to the RGBW image signal obtained by executing the rendering of the RGB image signal, as described above.

In FIG. 21, hatched blocks referred to as "B" represent sub-pixels SB outputting blue light (i.e., having the luminance value which is not 0).

If the sub-pixels SR, SG, SB, and SW are arrayed in the row direction from the right side, in the pixel array (pixels PX), the array of the sub-pixel SB in which the luminance value included in the RGBW image signal after executing the conversion for the RGB image signal is not 0 is an inverse of the array illustrated in FIG. 18 with respect to the columnar direction of the pixel array used as an axis.

For this reason, if the sub-pixels SR, SG, SB, and SW are arrayed in the row direction from the right side, the degradation in image quality can be suppressed similarly to the case where the sub-pixels SR, SG, SB, and SW are arrayed in the row direction from the left side, by executing the above-described rendering illustrated in FIG. 20 with the right end of each row of the pixel array referred to as the start end and the left end of each row of the pixel array referred to as the terminal end.

The pixel array described in the present embodiment is a mere example and the other pixel array may be employed similarly to the above-described first embodiment.

Third Embodiment

Next, a third embodiment will be explained. A configuration and the like of a display device according to the present embodiment is the same as those of the above-described first embodiment, and will be arbitrarily described with reference to FIG. 1, FIG. 2, and the like.

The pixels PX including the sub-pixels SR, SG, SB, and SW are arrayed on the display panel 11 in the first and second embodiments, but the present embodiment is different from the first and second embodiments in terms of the fact that the pixels PX including sub-pixels SR, SG1, SB, and SG2 are arrayed on the display panel 11.

Figure 22:
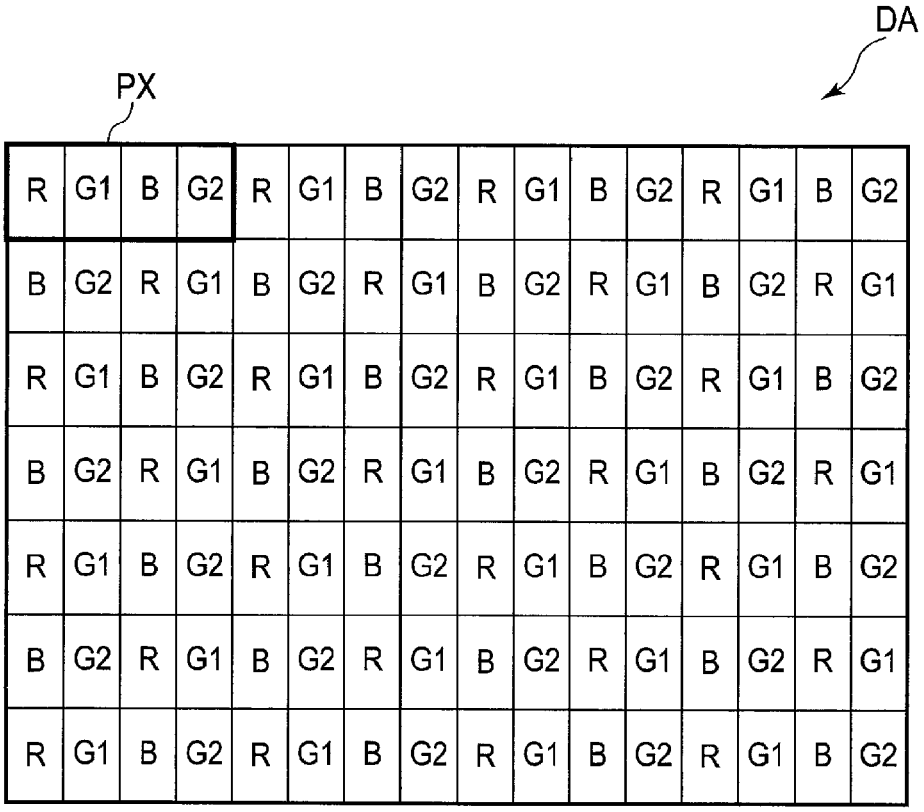
FIG. 22 is a diagram illustrating an example of pixel array in the third embodiment.

The pixel array in the present embodiment will be explained with reference to FIG. 22. FIG. 22 simply illustrates the array (pixel array) of the pixels PX arrayed on the display panel 11 (display area DA) in the present embodiment.

In the present embodiment, each of the pixels PX arranged on the display panel 11 includes the sub-pixels SR, SG1, SB, and SG2 as described above. Blocks arranged in a matrix in FIG. 22 represent the sub-pixels included in each of the pixels PX. In addition, the block referred to as "R" represents sub-pixel SR, the block referred to as "G1" represents sub-pixel SG1, the block referred to as "B" represents sub-pixel SB, and the block referred to as "G2" represents sub-pixel SG2.

The sub-pixels SG1 and SG2 are sub-pixels which output light corresponding to a green wavelength band. The sub-pixels SR and SB have been described above in the first embodiment.

When each pixel PX thus includes the sub-pixels SR, SG1, SB, and SG2, white color can be reproduced by, for example, allowing light to be output from each of the sub-pixels SR, SG1, SB, and SG2. In addition, since two sub-pixels SG1 and SG2 corresponding to the green wavelength band arc included in one pixel PX, each of the sub-pixel SR corresponding to the red wavelength band and the sub-pixel SB corresponding to the blue wavelength band is designed to be brighter for two pixels.

Odd-numbered rows (for example, first row and the like) of the pixel array in the present embodiment are constituted such that the pixels PX including the sub-pixels SR, SG1, SB, and SG2 arranged in the row direction are arranged in the row direction, as illustrated in FIG. 22. Similarly, even-numbered rows (for example, second row and the like) of the pixel array in the present embodiment are constituted such that the pixels PX including the sub-pixels SR, SG1, SB, and SG2 arranged in the row direction are arranged in the row direction.

According to the configuration that each pixel PX includes the sub-pixels SR, SG1, SB, and SG2, the lightness can be improved and the range of colors which can be reproduced in the pixel PX (color reproduction range) can be expanded as compared with the configuration that each pixel PX includes the sub-pixels SR, SG, and SB as illustrated in FIG. 4.

In the present embodiment, the pixels PX of odd-numbered rows and the pixels PX of even-numbered rows are arranged such that the sub-pixels SR included in the pixels PX of odd-numbered rows are adjacent to the sub-pixels SB included in the pixels PX of even-numbered rows in the columnar direction. In other words, in the present embodiment, the pixels PX of odd-numbered rows and the pixels PX of even-numbered rows are arranged to be shifted by half pixel in the row direction.

In this pixel array, the sub-pixels SR are arranged at start ends of the odd-numbered rows while the sub-pixels SG2 are arranged at terminal ends of the odd-numbered rows. In addition, the sub-pixels SB are arranged at start ends of the even-numbered rows while the sub-pixels SG1 are arranged at terminal ends of the even-numbered rows.

Next, a procedure of the display device 10 displaying the images on the display panel 11 will be explained. The processing executed by the panel driver 113 will be explained here with reference to FIG. 5.

First, the panel driver 113 inputs, for example, the image signal output from the host device HOS (step S1). The image signal input in step S1 is assumed to be an RGB image signal including the luminance value of the sub-pixels SR, SG, and SB for each pixel to display, for example, a one-frame image, similarly to the above-described first embodiment.

The sub-pixels SR, SG1, SB, and SG2 are included in each of the pixels PX arranged on the display panel 11 as explained above. In this case, since the RGB image signal input in step S1 does not correspond to the display panel 11 (i.e., is not an image signal including the luminance values of the sub-pixels SR, SG1, SB, and SG2), the RGB image signal needs to be converted into an RGBG image signal when the images are displayed on the display panel 11 based on the RGB image signal. The RGBG image signal is an image signal including the luminance values of the sub-pixels SR, SG1, SB, and SG2 for each pixel PX.

For this reason, the panel driver 113 executes rendering for the RGB image signal input in step S1 (step S2). Details of the rendering in the present embodiment will be explained later.

When the processing in step S2 is executed, the panel driver 113 outputs the RGBG image signal as a result of the rendering in step S2 (step S3). The panel driver 113 thereby drives the scanning line driver 21, the data signal line driver 22, the power line driver 23, and the like based on the RGBG image signal to display images on the display panel 11.

Details of the rendering in the present embodiment are explained below. First, conversion of converting the RGB image signal (luminance values of the sub-pixels SR, SG, and SB) into the RGBG image signal (luminance values of the sub-pixels SR, SG1, SB, and SG2) in the rendering will be explained with reference to FIG. 23.

In the present embodiment, the RGB image signals for two pixels (i.e., the luminance values of the sub-pixels SR, SG, and SB for two pixels) are converted into the RGBG image signal for one pixel (i.e., the luminance values of the sub-pixels SR, SG1, SB, and SG2 for one pixel).

Figure 23:
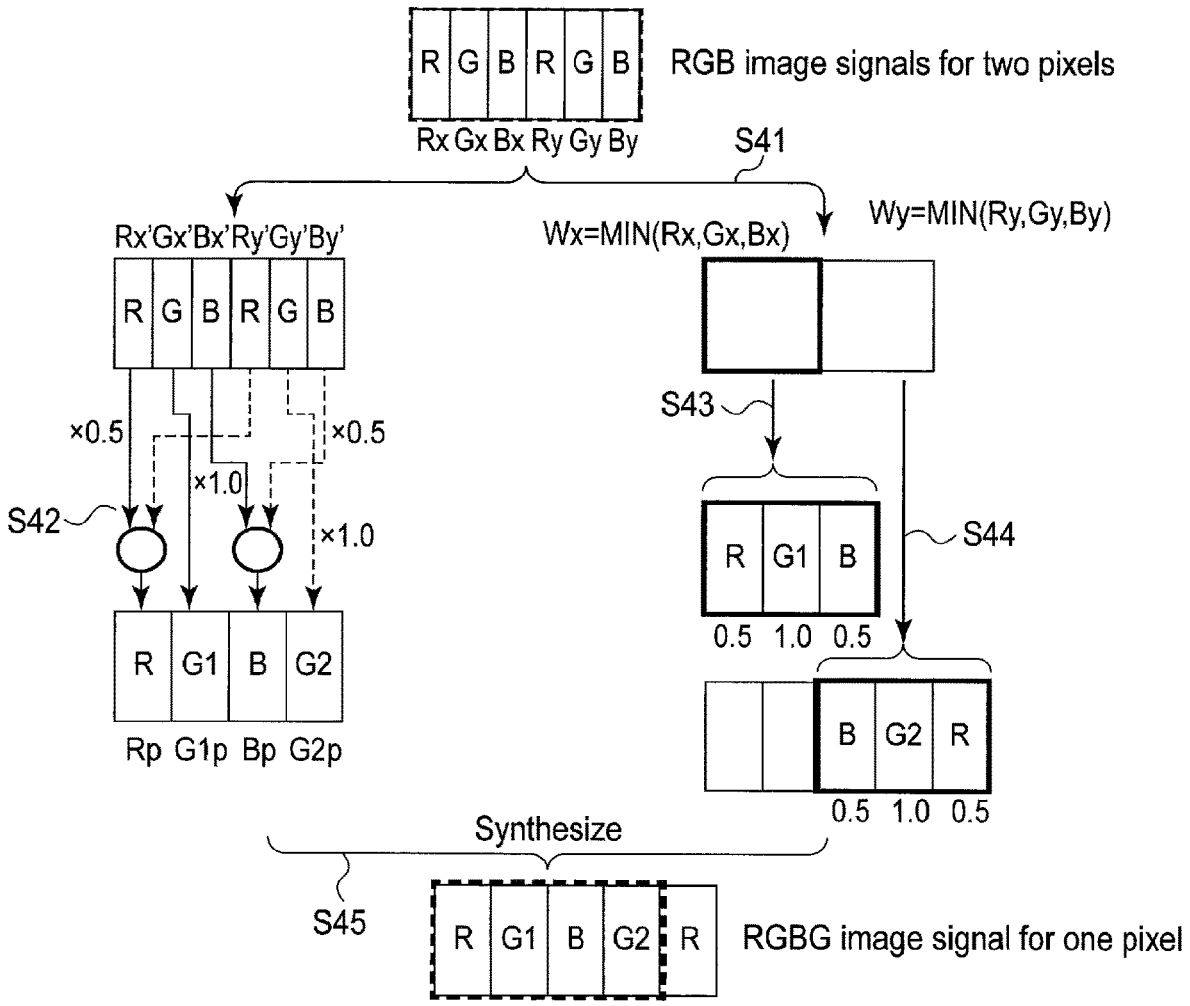
FIG. 23 is a diagram illustrating an example of conversion of converting an RGB image signal into an RGBW image signal.

As illustrated in FIG. 23, the luminance values of the sub-pixels SR, SG, and SB included in either RGB image signal for one pixel (first RGB image signal) of the RGB image signals for two pixels that are to be converted into the RGBG image signal for one pixel are Rx, Gx, and Bx, and the luminance values of the sub-pixels SR, SG, and SB included in the other RGB image signal for one pixel (second RGB image signal) are Ry, Gy, and By.

In the conversion, a white component and color components other than the white component are extracted from each of the first RGB image signal and the second RGB image signal, similarly to step S1 illustrated in FIG. 6 (step S41).

Next, the processing in step S42 is executed. In step S42, the luminance value Rp of the sub-pixel SR in the RGBG image signal is computed based on the luminance value Rx' of the sub-pixel SR included in the color components extracted from the first RGB image signal and the luminance value Ry' of the sub-pixel SR included in the color components extracted from the second RGB image signal. In this case, a value of summing a value obtained by multiplying the luminance value Rx' by 0.5 and a value obtained by multiplying the luminance value Ry' by 0.5 is computed as luminance value Rp.

In addition, in step S42, the value obtained by multiplying the luminance value Gx' of the sub-pixel SG included in the color components extracted from the first RGB image signal by 1.0 is computed as luminance value Glp of the sub-pixel SG1 in the RGBW image signal.

In addition, in step S42, the luminance value Bp of the sub-pixel SB in the RGBG image signal is computed based on the luminance value Bx' of the sub-pixel SB included in the color components extracted from the first RGB image signal and the luminance value By' of the sub-pixel SR included in the color components extracted from the second RGB image signal. In this case, a value of summing a value obtained by multiplying the luminance value Bx' by 0.5 and a value obtained by multiplying the luminance value By' by 0.5 is computed as luminance value Bp.

Furthermore, in step S42, the value obtained by multiplying the luminance value Gy' of the sub-pixel SG included in the color components extracted from the second RGB image signal by 1.0 is computed as luminance value Glp of the sub-pixel SG2 in the RGBW image signal.

In step S42, the luminance values of the sub-pixels SR, SG1, SB, and SG2 in the RGBG image signal are computed based on the color components extracted from the first RGB image signal and the color components extracted from the second RGB image signal.

In contrast, the luminance values of the sub-pixels SR, SG1, and SB in the RGBG image signal are also computed from the white component extracted from the first RGB image signal (step S43). In this case, the value obtained by multiplying the luminance value of the sub-pixel SR included in the white component extracted from the first RGB image signal by 0.5, the value obtained by multiplying the luminance value of the sub-pixel SG by 1.0, and the value obtained by multiplying the luminance value of the sub-pixel SB by 0.5, are computed as the luminance values of the sub-pixels SR, SG1, and SB, respectively.

In addition, the luminance values of the sub-pixels SB, SG2, and SR in the RGBG image signal are also computed from the white component extracted from the second RGB image signal (step S44). In this case, the value obtained by multiplying the luminance value of the sub-pixel SB included in the white component extracted from the second RGB image signal by 0.5, the value obtained by multiplying the luminance value of the sub-pixel SG by 1.0, and the value obtained by multiplying the luminance value of the sub-pixel SR by 0.5, are computed as the luminance values of the sub-pixels SB, SG2, and SR, respectively.

Finally, as illustrated in FIG. 23, the RGBW image signal including the luminance values of the sub-pixels SR, SG1, SB, and SG2 is generated by synthesizing (summing) the values computed as the sub-pixels SR, SG1, SB, and SG2 in the RGBG image signal in step S42, the values computed as the luminance values of the sub-pixels SR, SG1, and SB in step S43, and the values computed as the sub-pixels SB, SG2, and SR in step S44.

The value computed as the luminance value of the sub-pixel SR in step S44 is added to the luminance value of the sub-pixel SR included in the RGBG image signal next to the RGBG image signal generated by the processing in steps S41 to S45 illustrated in FIG. 23 and is represented by the sub-pixel SR.

In the present embodiment, the RGB image signal to display a one-frame image can be converted into the RGBG image signal by executing the above processing for each RGB image signal for two pixels.

Figure 24:
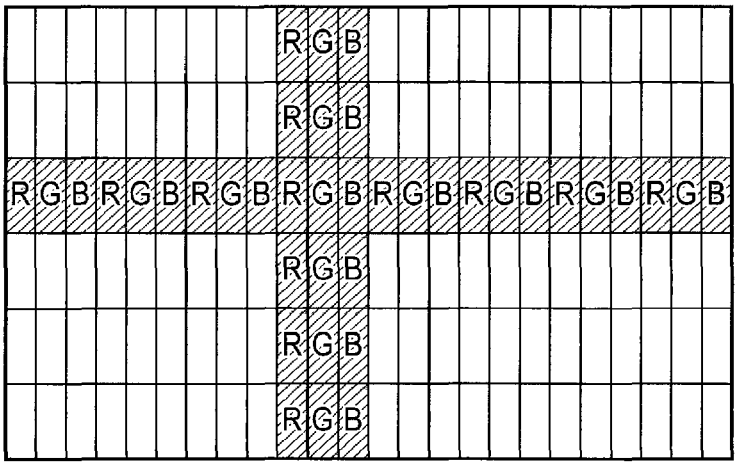
FIG. 24 is a diagram illustrating an example of the RGB image signal to display white cross lines.
Figure 25:
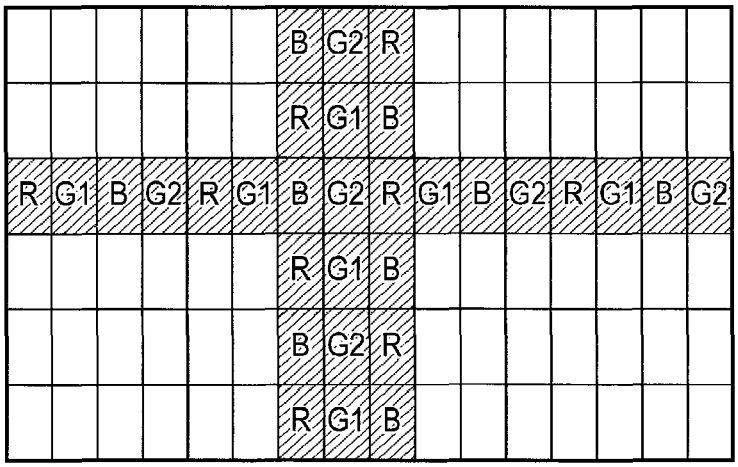
FIG. 25 is a diagram illustrating an example of the RGBW image signal into which the RGB image signal is converted.

White color is reproduced by outputting the light from the sub-pixels SR, SG, and SB but, for example, when the RGB image signal to display a white cross line is input by outputting the light from the sub-pixels SR, SG, and SB as illustrated in FIG. 24, the RGB image signal is converted into the RGBG image signal which allows the light to be output from the sub-pixels SR, SG1, SB, and SG2 as illustrated in FIG. 25. In FIG. 24 and FIG. 25, hatched blocks represent positions of the sub-pixels outputting the light based on the image signals.

The sub-pixels to which the luminance values computed in step S42 illustrated in FIG. 23 are allocated have been explained in the above-described first embodiment, and its detailed explanations are omitted here.

For example, conversion of the RGB image signal to display an image including a white frame (white line) along the outer periphery of the display area DA into the RGBG image signal will be explained here.

Figure 26:
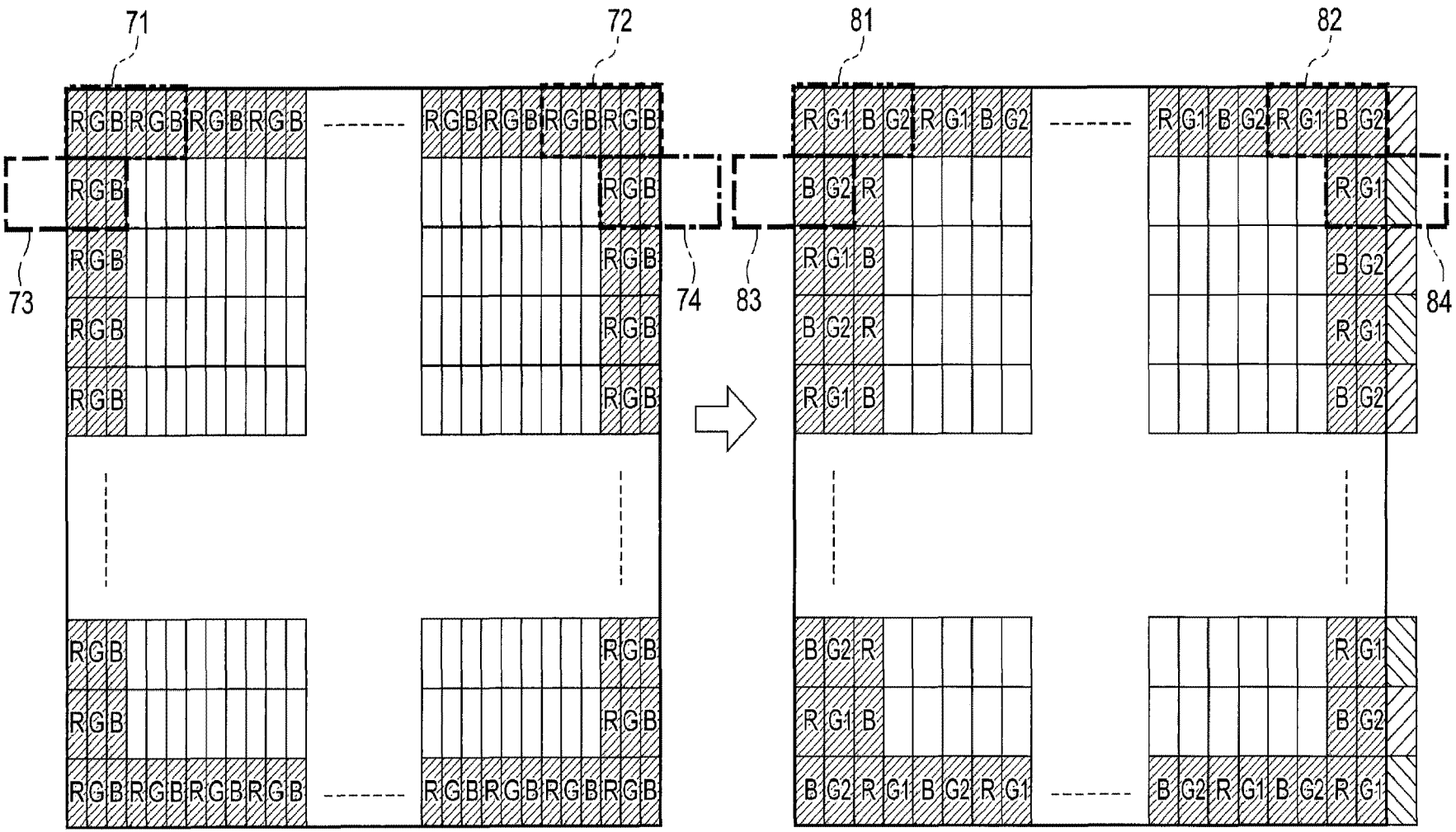
FIG. 26 is a diagram illustrating correspondence of the RGB image signal to the RGBG image signal into which the RGB image signal is converted by the conversion.

FIG. 26 illustrates correspondence of the RGB image signal to display an image including a white frame along the outer periphery of the display area DA to the RGBG image signal into which the RGB image signal is converted by the conversion.

In FIG. 26, hatched blocks represent the sub-pixels outputting the light (i.e., having the luminance value which is not 0), and characters (R, G1, B, and G2) in the blocks represent the colors (i.e., sub-pixels SR, SG1, SB, and SG2) of light output from the sub-pixels.

As illustrated in FIG. 26, if the conversion is executed for RGB image signals 71 for two pixels corresponding to the start end (left end) of the first row of the pixel array, the RGB image signals 71 are converted into an RGBG image signal 81. Similarly, if the conversion is executed for the RGB image signals 72 for two pixels corresponding to the terminal end (right end) of the first row of the pixel array, the RGB image signals 72 are converted into an RGBG image signal 82. The RGB image signals 71 and 72 have been explained here, and the conversion is also executed similarly for the other RGB image signals arranged between the RGB image signals 71 and 72 in the row direction. In addition, the first row of the pixel array has been explained, and the processing is also executed for the other odd-numbered rows.

According to the pixel array in the present embodiment, the pixels PX of odd-numbered rows and the pixels PX of even-numbered rows are arranged to be shifted by half pixel in the row direction.

In such a pixel array, for example, not the sub-pixel SR, but the sub-pixel SB is arranged at the start end of the second row of the pixel array. If the same processing as that for the odd-numbered rows (for example, the first row) is executed for the second row of the pixel array, the RGBG image signal corresponding to the pixel array in the present embodiment cannot be obtained since the luminance value of the sub-pixel SR is allocated to the start end of the second row.

For this reason, in the second row of the pixel array, as illustrated in FIG. 26, the conversion is executed for RGB image signals 73 for two pixels, i.e., the first RGB image signal including 0 as the luminance values of the sub-pixels SR, SG, and SB and the second RGB image signal including the luminance values of the sub-pixels SR, SG, and SB corresponding to the white frame, and the RGB image signal 73 is thereby converted into an RGBW image signal 83. According to this, the luminance values of the sub-pixels SB and SG1 included in the RGBG image signal 83 can be used as the luminance values of the sub-pixels SB and SG2 arranged at the start end of the second row of the pixel array.

After that, the processing of converting the RGB image signal for two pixels into the RGBG image signal for one pixel is executed sequentially, but the RGB image signal for one pixel needs to be converted into the RGBG image signal by the above-described pixel array, at the terminal end of the second row of the pixel array.

In this case, as illustrated in FIG. 26, the conversion is executed for the RGB image signals 74 for two pixels, i.e., the first RGB image signal including the luminance values of the sub-pixels SR, SG, and SB corresponding to the white frame (i.e., the RGB image signal for one pixel corresponding to the terminal end of the second row) and the second RGB image signal including 0 as the luminance values of the sub-pixels SR, SG, and SB, and the RGB image signal 74 is thereby converted into the RGBW image signal 84. According to this, the luminance values of the sub-pixels SR and SG1 included in the RGBG image signal 84 can be used as the luminance values of the sub-pixels SR and SG1 arranged at the terminal end of the second row of the pixel array.

When the above conversion is executed, white color to be reproduced based on the luminance values of the sub-pixels SR, SG, and SB of the first RGB image signal included in the RGB image signal 72 corresponding to the first row of the pixel array can be reproduced by the light output based on, for example, the luminance value of the sub-pixel SR, the luminance value of the sub-pixel SG1, and a part of the luminance value of the sub-pixel SB which are included in the RGBG image signal 82.

In contrast, white color to be reproduced based on the luminance values of the sub-pixels SR, SG, and SB of the second RGB image signal included in the RGB image signal 72 need to be reproduced by the light output based on a part of the luminance value of the sub-pixel SB included in the RGBG image signal 82, the luminance value of the sub-pixel SG2 included in the RGBG image signal 82, and the luminance value of the sub-pixel SR which is to be included in the RGBG image signal next to the RGBG image signal 82 explained with reference to FIG. 23.

However, since the sub-pixel arranged at the terminal end of the first row of the pixel array is the sub-pixel SG2 and the light (i.e., the red component) output from the sub-pixel SR cannot be used, the red component is short at the terminal end of the first row of this pixel array. The same problem occurs in the other odd-numbered rows other than the first row of the pixel array.

In addition, white color to be reproduced based on the luminance values of the sub-pixels SR, SG, and SB of the first RGB image signal included in the RGB image signal 74 corresponding to the first row of the pixel array needs be reproduced by the light output based on, for example, the luminance value of the sub-pixel SR, the luminance value of the sub-pixel SG1, and a part of the luminance value of the sub-pixel SB which are included in the RGBG image signal 84.

However, since the sub-pixel arranged at the terminal end of the second row of the pixel array is the sub-pixel SG1 and the light (i.e., the blue component) output from the sub-pixel SB cannot be used, the blue component is short at the terminal end of the second row of this pixel array. The same problem occurs in the even-numbered rows other than the second row of the pixel array.

In this case, the red component or the blue component lacks at the terminal portion of each row of the pixel array. According to this, color tingled with green is visually recognized around the white frame (white line) displayed in the columnar direction at the terminal portion of each row of the pixel array and the degradation in image quality is caused.

Thus, in the present embodiment, the luminance values of the sub-pixels SR and SB in the RGBG image signal is varied (adjusted) based on the luminance values of the sub-pixels SR and SB included in the RGB image signal, which cannot be represented in the display panel 11 (i.e., pixels PX) by the conversion.

Figure 27:
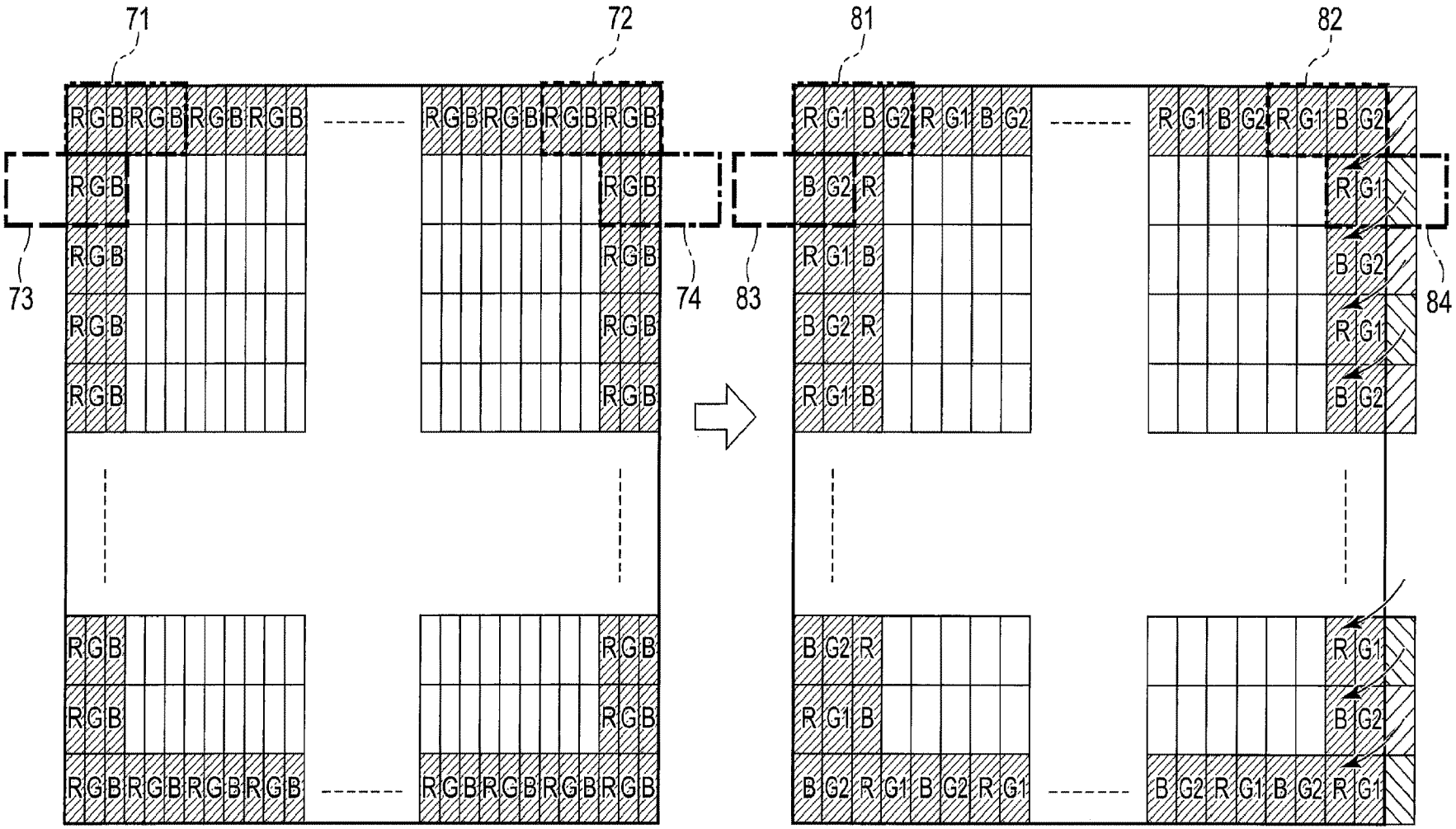
FIG. 27 is a conceptual diagram illustrating variation of the luminance value of the sub-pixels in the rendering.

More specifically, as illustrated in FIG. 27, for example, the luminance value of the sub-pixel SR to output the light of the red component to reproduce white color together with the light output based on a part of the luminance value of the sub-pixel SB and the luminance value of the sub-pixel SG2 included in the RGBG image signal 82 into which the RGB image signal 72 is converted is added to the luminance value of the sub-pixel SR included in the pixel PX arranged at the terminal end of the next row (i.e., second row). The first row of the pixel array is explained here and the same operation is executed in the odd-numbered rows other than the first row.

In addition, for example, the luminance value of the sub-pixel SB to output the light of the blue component to reproduce white color together with the light output based on the luminance value of the sub-pixel SR and the luminance value of the sub-pixel SG1 included in the RGBG image signal 84 into which the RGB image signal 74 is converted is added to the luminance value of the sub-pixel SB included in the pixel PX arranged at the terminal end of the next row (i.e., third row). The second row of the pixel array is explained here and the same operation is executed in the even-numbered rows other than the second row. In the last row of the pixel array, this processing is not executed since a next row does not exist.

When the conversion is executed for the RGB image signal corresponding to the first row of the pixel array, for example, in the rendering executed in the present embodiment, processing corresponding to the processing in step S22 illustrated in FIG. 16 is executed. More specifically, the luminance value of the sub-pixel SR added to the luminance value of the sub-pixel SR of the second row that is the next row is stored in the buffer.

When the conversion is executed for the RGB image signal corresponding to the second row of the pixel array, processing corresponding to the processing in step S23 illustrated in FIG. 16 is executed, and the luminance value stored in the buffer is added to the luminance value of the sub-pixel SR included in the pixel PX arranged at the terminal end of the second row of the pixel array. Furthermore, the luminance value of the sub-pixel SB added to the luminance value of the sub-pixel SB of the third row that is the next row is stored in the buffer.

When the conversion is executed for the RGB image signal corresponding to the third row of the pixel array, the luminance value stored in the buffer is added to the luminance value of the sub-pixel SB included in the pixel PX arranged at the terminal end of the third row of the pixel array. Furthermore, the luminance value of the sub-pixel SG added to the luminance value of the sub-pixel SB of the fourth row that is the next row is stored in the buffer.

The same processing is executed below. When the processing is executed in the last row of the pixel array, the rendering is finished.

In such rendering, the RGBG image signal to enable the red component (i.e., luminance value of the sub-pixel SR) and the blue component (i.e., luminance value of the sub-pixel SB) that are not displayed on the display panel 11 by the conversion of converting the RGB image signal into the RGBG image signal to be represented by the sub-pixels SR and SB of the next row can be obtained. When the rendering is finished, the images are displayed on the display panel 11 based on the RGBG image signal obtained by the rendering.

In the present embodiment, as described above, the luminance value of the sub-pixel SR included in the RGB image signal which is to be reproduced by the sub-pixel SR (first sub-pixel) next to the sub-pixel SG2 (fourth sub-pixel) arranged at the terminal end of the odd-numbered row by the conversion is added to the luminance value of the sub-pixel SR included in the pixel PX arranged at the terminal end of the even-numbered row next to this odd-numbered row.

Similarly, in the present embodiment, the luminance value of the sub-pixel SB included in the RGB image signal which is to be reproduced by the sub-pixel SB next to the sub-pixel SG1 arranged at the terminal end of the even-numbered row by the conversion is added to the luminance value of the sub-pixel SB included in the pixel PX arranged at the terminal end of the odd-numbered row next to this even-numbered row.

In the present embodiment, having such a configuration, for example, since it is possible to compensate for the short red component and blue component at the terminal end of each row when displaying the white frame as explained with reference to FIG. 26, an image having little difference from the image to be displayed by the input RGB image signal can be displayed and the degradation in image quality can be suppressed.

The sub-pixels SR, SG1, SB, and SG2 are arrayed in the row direction of the pixel array from the left side, in each pixel PX of the present embodiment but, for example, the sub-pixels may be arrayed in inverse order. In this case, the degradation in image quality can be suppressed by executing the rendering with the right end of each row of the pixel array used as the start end and the left end used as the terminal end, as described in the first embodiment.

The pixel array described in the present embodiment is a mere example and the other pixel array may be employed similarly to the above-described first embodiment.

Fourth Embodiment

Next, a fourth embodiment will be explained. A configuration and the like of a display device according to the present embodiment is the same as those of the above-described first embodiment, and will be arbitrarily described with reference to FIG. 1, FIG. 2, and the like.

The pixels PX including the sub-pixels SR, SG, SB, and SW are arrayed on the display panel 11 in the first and second embodiments, and the pixels PX including the sub-pixels SR, SG1, SB, and SG2 are arrayed on the display panel 11 in the third embodiment but, the present embodiment is different from each of the above embodiments in terms of the fact that pixels PX including the sub-pixels SR, SY1, SG1, SB, SY1, and SG2 are arrayed on the display panel 11.

Figures 28, 29:
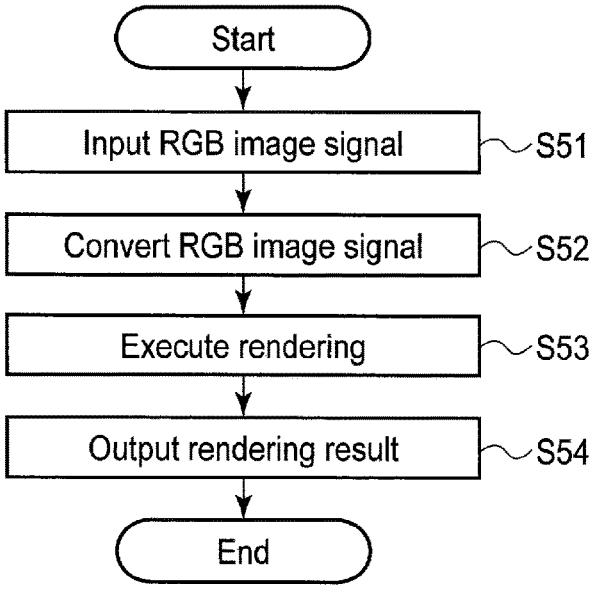
FIG. 28 is a diagram illustrating an example of pixel array in the fourth embodiment.
FIG. 29 is a flow chart illustrating an example of procedure of the display device in a case of displaying the image on a display panel.

The pixel array in the present embodiment will be explained with reference to FIG. 28. FIG. 28 simply illustrates the array (pixel array) of the pixels PX arrayed on the display panel 11 (display area DA) in the present embodiment.

In the present embodiment, each of the pixels PX arranged on the display panel 11 includes the sub-pixels SR, SY1, SG1, SB, SY2, and SG2 as described above. Blocks arranged in a matrix in FIG. 28 represent the sub-pixels included in each of the pixels PX. In addition, the block referred to as "R" represents sub-pixel SR, the block referred to as "Y1" represents sub-pixel SY1, the block referred to as "G1" represents sub-pixel SG1, the block referred to as "B" represents sub-pixel SB, the block referred to as "Y2" represents sub-pixel SY2, and the block referred to as "G2" represents sub-pixel SG2.

The sub-pixels SY1 and SY2 are sub-pixels which output light corresponding to wavelength bands of colors between green and yellow (i.e., green tinged with yellow). In addition, the sub-pixels SG1 and SG2 are sub-pixels which output light corresponding to wavelength bands of colors between green and blue (i.e., green tinged with blue). The sub-pixels SR and SB have been described above in the first embodiment.

Odd-numbered rows (for example, first row and the like) of the pixel array in the present embodiment are constituted such that the pixels PX including the sub-pixels SR, SY1, SG1, SB, SY2, and SG2 arranged in the row direction are arranged in the row direction, as illustrated in FIG. 28. Similarly, even-numbered rows (for example, second row and the like) of the pixel array in the present embodiment are constituted such that the pixels PX including the sub-pixels SR, SY1, SG1, SB, SY2, and SG2 arranged in the row direction are arranged in the row direction.

According to the configuration that each pixel PX includes the sub-pixels SR, SY1, SG1, SB, SY2, and SG2, the lightness can be improved and the range of colors which can be reproduced in the pixel PX (color reproduction range) can be expanded as compared with the configuration that each pixel PX includes the sub-pixels SR, SG, and SG as illustrated in FIG. 4.

In the present embodiment, the pixels PX of odd-numbered rows and the pixels PX of even-numbered rows are arranged such that the sub-pixels SR included in the pixels PX of odd-numbered rows are adjacent to the sub-pixels SB included in the pixels PX of even-numbered rows in the columnar direction. In other words, in the present embodiment, the pixels PX of odd-numbered rows and the pixels PX of even-numbered rows are arranged to be shifted by half pixel in the row direction.

In this pixel array, the sub-pixels SR are arranged at start ends of the odd-numbered rows while the sub-pixels SG2 are arranged at terminal ends of the odd-numbered rows. In addition, the sub-pixels SB are arranged at start ends of the even-numbered rows while the sub-pixels SG1 are arranged at terminal ends of the even-numbered rows.

Next, a procedure of the display device 10 displaying the images on the display panel 11 will be explained with reference to a flowchart illustrated in FIG. 29. The processing executed by the panel driver 113 will be mainly explained here.

First, the panel driver 113 inputs, for example, the image signal output from the host device HOS (step S51). The image signal input in step S1 is assumed to be an RGB image signal including the luminance value of the sub-pixels SR, SG, and SB for each pixel to display, for example, a one-frame image.

Figure 30:
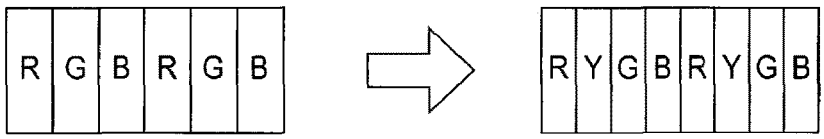
FIG. 30 is a diagram illustrating conversion of the RGB image signal into a four-color image signal.

Next, the panel driver 113 executes processing (three-color/four-color conversion) of converting the RGB image signal input in step S1 into an image signal (hereinafter referred to as four-color image signal) including the luminance values of the sub-pixels SR, SY, SG, and SB (step S52). According to the processing in step S52, the RGB image signal for one pixel is converted into four-color image signal for one pixel as illustrated in FIG. 30.

The sub-pixels SR, SY1, SG1, SB, SY2, and SG2 are included in each of the pixels PX arranged on the display panel 11 as explained above. In this case, since the four-color image signals into which the RGB image signal is converted in step S52 does not correspond to the display panel 11 (i.e., is not an image signal including the luminance values of the sub-pixels SR, SY1, SG1, SB, SY2, and SG2), the four-color image signals need to be converted into an RYGB image signal when the images are displayed on the display panel 11 based on the four-color image signals. The RYGB image signal is an image signal including the luminance values of the sub-pixels SR, SY1, SG1, SB, SY2, and SG2 for each pixel PX.

For this reason, the panel driver 113 executes rendering for the four-color image signals input in step S52 (step S53). Details of the rendering in the present embodiment will be explained later.

When the processing in step S53 is executed, the panel driver 113 outputs the RYGB image signal as a result of the rendering in step S53 (step S54). The panel driver 113 thereby drives the scanning line driver 21, the data signal line driver 22, the power line driver 23, and the like based on the RYGB image signal to display images on the display panel 11.

Figure 31:
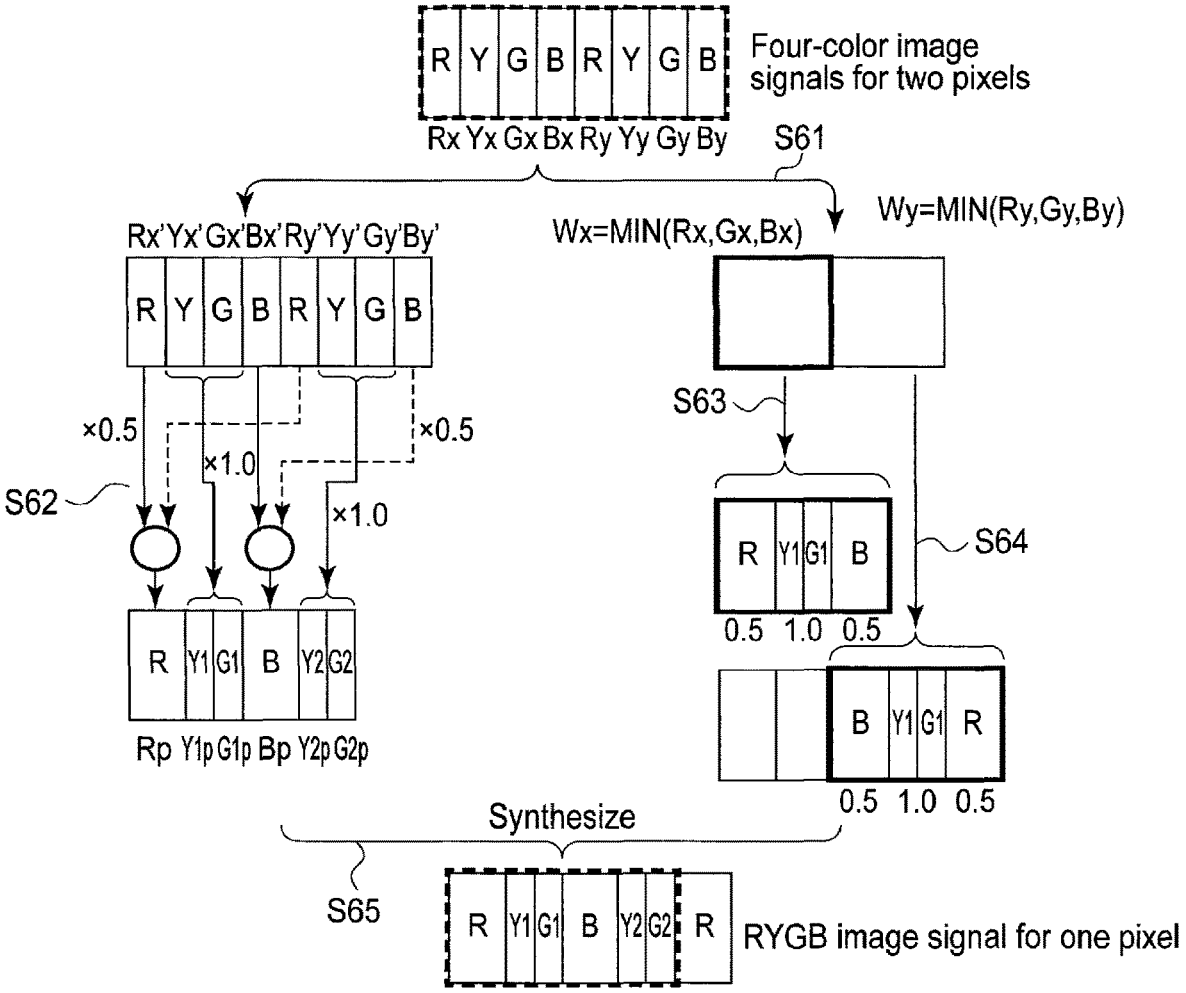
FIG. 31 is a diagram illustrating an example of conversion of converting a four-color image signal into an RGBW image signal.

The rendering in the present embodiment is explained below. FIG. 31 is a diagram illustrating the conversion of converting the four-color image signals (luminance values of the sub-pixels SR, SY, SG, and SB) into the RYGB image signal (luminance values of the sub-pixels SR, SY1, SG1, SB, SY2, and SG2) in the rendering.

In the present embodiment, the four-color image signals for two pixels (i.e., the luminance values of the sub-pixels SR, SY, SG, and SB for two pixels) are converted into the RYGB image signal for one pixel (i.e., the luminance values of the sub-pixels SR, SY1, SG1, SB, SY2, and SG2 for one pixel).

Processing in steps S61 to S65 illustrated in FIG. 31 is executed as the conversion in the present embodiment. As illustrated in FIG. 31, the processing in steps S61 to S65 is the same as the processing in steps S41 to S45 using the luminance value of the sub-pixel SG included in the RGB image signal explained with reference to FIG. 23 as the luminance values of the sub-pixels SY and SG, using the luminance value of the sub-pixel G1 in the RGBG image signal explained with reference to FIG. 23 as the sub-pixels Y1 and G1, and using the luminance value of the sub-pixel G2 as the sub-pixels Y2 and G2.

Furthermore, the present embodiment is the same as the above-described third embodiment in terms of the fact that, for example, when the image including the white frame (white line) along the outer periphery of the display area DA is displayed, the red component is short at the terminal end of the odd-numbered row of the pixel array explained with reference to FIG. 26, and the blue component is short at the terminal end of the even-numbered row. For this reason, in the present embodiment, the processing explained with reference to FIG. 27 and the like is executed in the above-described third embodiment, to compensate for the red component which is short at the terminal end of the odd-numbered row and the blue component which is short at the terminal end of the even-numbered row.

In the present embodiment, as described above, the degradation in image quality can be suppressed similarly to the above-described third embodiment, even if each of the pixels PX arranged on the display panel 11 includes the sub-pixels SR, SY1, SG1, SB, SY2, and SG2.

The sub-pixels SR, SY1, SG1, SB, SY2, and SG2 are arrayed in the row direction of the pixel array from the left side, in each pixel PX of the present embodiment but, for example, the sub-pixels may be arrayed in inverse order. In this case, the degradation in image quality can be suppressed by executing the rendering with the right end of each row of the pixel array used as the start end and the left end used as the terminal end, as described in the first embodiment.

The pixel array described in the present embodiment is a mere example and the other pixel array may be employed similarly to the above-described first embodiment.

The inventions according to the embodiments will be noted below.

[C1]

A display device, comprising:

a display panel on which first pixels including first sub-pixels, second sub-pixels, third sub-pixels, and fourth sub-pixels arrayed in a row direction and constituting a first row of a pixel array, and second pixels including the first sub-pixels, the second sub-pixels, the third sub-pixels, and the fourth sub-pixels arrayed in the row direction and constituting a second row adjacent to the first row in a columnar direction in the pixel array are alternately arranged in the columnar direction; and a display controller inputting a first image signal including luminance values of the first sub-pixels, the second sub-pixels, and the third sub-pixels corresponding to respective rows of the pixel array, and displaying an image on the display panel, wherein the first pixels and the second pixels are arranged such that the first sub-pixels included in the first pixels are adjacent to the third sub-pixels included in the second pixels in the columnar direction, and the display controller is configured to:

execute conversion of converting the input first image signal into a second image signal including luminance values of the first sub-pixels, the second sub-pixels, the third sub-pixels, and the fourth sub-pixels, vary the luminance values of the third sub-pixels included in the second image signal, based on the luminance values of the third sub-pixels included in the first image signal which become unable to be represented in the display panel due to the pixel array based on the first pixels constituting the first row and the second pixels constituting the second row, if the conversion is executed, and display the image on the display panel, based on the second image signal in which the luminance values of the third sub-pixels are varied.

[C2]

The display device of [C1], wherein the first sub-pixel is arranged at a start end of the first row, and the fourth sub-pixel is arranged at a terminal end of the first row, the third sub-pixel is arranged at a start end of the second row, and the second sub-pixel is arranged at a terminal end of the second row, and the display controller is configured to add the luminance value of the third sub-pixel corresponding to the second row included in the first image signal, which is to be reproduced by a third sub-pixel next to the second sub-pixel arranged at the terminal end of the second row by the conversion, to the luminance value of the third sub-pixel included in the first pixel arranged at the terminal end of the first row next to the second row, and thereby vary the luminance value of the third sub-pixel.

[C3]

The display device of [C2], wherein the display controller is configured to add the luminance value of the third sub-pixel corresponding to the second row included in the first image signal, which is to be reproduced by the third sub-pixel included in the first pixel arranged at the start end of the first row by the conversion, to the luminance value of the third sub-pixel included in the second pixel arranged at the second row, and thereby vary the luminance value of the third sub-pixel.

[C4]

The display device of any one of [C1] to [C3], wherein the first sub-pixel is a sub-pixel outputting light corresponding to a red wavelength band, the second sub-pixel is a sub-pixel outputting light corresponding to a green wavelength band, the third sub-pixel is a sub-pixel outputting light corresponding to a blue wavelength band, and the fourth sub-pixel is a sub-pixel outputting light corresponding to a white wavelength band.

[C5]

The display device of [C2], wherein the display controller is configured to add at least a part of the luminance value of the first sub-pixel corresponding to the first row included in the first image signal, which is to be reproduced by the first sub-pixel next to the fourth sub-pixel arranged at the terminal end of the first row by the conversion, to the luminance value of the first sub-pixel included in the second pixel arranged at the terminal end of the second row next to the first row.

[C6]

The display device of [C5], wherein the first sub-pixel is a sub-pixel outputting light corresponding to a red wavelength band, the second sub-pixel and the fourth sub-pixel are sub-pixels outputting light corresponding to a green wavelength band, and the third sub-pixel is a sub-pixel outputting light corresponding to a blue wavelength band.

[C7]

The display device of [C5], wherein the first sub-pixel is a sub-pixel outputting light corresponding to a red wavelength band, the second sub-pixel and the fourth sub-pixel include a sub-pixel outputting light corresponding to a wavelength band of a color between yellow and green and a sub-pixel outputting light corresponding to a wavelength band of a color between green and blue, respectively, and the third sub-pixel is a sub-pixel outputting light corresponding to a blue wavelength band.

[C8]

A display method executed by a display device comprising a display panel on which first pixels including first sub-pixels, second sub-pixels, third sub-pixels, and fourth sub-pixels arrayed in a row direction and constituting a first row of a pixel array, and second pixels including the first sub-pixels, the second sub-pixels, the third sub-pixels, and the fourth sub-pixels arrayed in the row direction and constituting a second row adjacent to the first row in a columnar direction in the pixel array are alternately arranged in the columnar direction, the method comprising:

inputting a first image signal including luminance values of the first sub-pixels, the second sub-pixels, and the third sub-pixels corresponding to respective rows of the pixel array; and displaying an image on the display panel, based on the input first image signal, wherein the first pixels and the second pixels are arranged such that the first sub-pixels included in the first pixels are adjacent to the third sub-pixels included in the second pixels in the columnar direction, and the displaying includes executing conversion of converting the input first image signal into a second image signal including luminance values of the first sub-pixels, the second sub-pixels, the third sub-pixels, and the fourth sub-pixels, varying the luminance values of the third sub-pixels included in the second image signal, based on the luminance values of the third sub-pixels included in the first image signal which become unable to be represented in the display panel due to the pixel array based on the first pixels constituting the first row and the second pixels constituting the second row, if the conversion is executed, and displaying the image on the display panel, based on the second image signal in which the luminance values of the third sub-pixels are varied.

[C9]

The display method of [C8], wherein the first sub-pixel is arranged at a start end of the first row, and the fourth sub-pixel is arranged at a terminal end of the first row, the third sub-pixel is arranged at a start end of the second row, and the second sub-pixel is arranged at a terminal end of the second row, and the varying includes adding the luminance value of the third sub-pixel corresponding to the second row included in the first image signal, which is to be reproduced by a third sub-pixel next to the second sub-pixel arranged at the terminal end of the second row by the conversion, to the luminance value of the third sub-pixel included in the first pixel arranged at the terminal end of the first row next to the second row.

[C10]

The display method of [C9], wherein the varying includes adding the luminance value of the third sub-pixel corresponding to the second row included in the first image signal, which is to be reproduced by the third sub-pixel included in the first pixel arranged at the start end of the first row by the conversion, to the luminance value of the third sub-pixel included in the second pixel arranged at the second row.

[C11]

The display method of any one of [C8] to [C10], wherein the first sub-pixel is a sub-pixel outputting light corresponding to a red wavelength band, the second sub-pixel is a sub-pixel outputting light corresponding to a green wavelength band, the third sub-pixel is a sub-pixel outputting light corresponding to a blue wavelength band, and the fourth sub-pixel is a sub-pixel outputting light corresponding to a white wavelength band.

[C12]

The display method of [C9], wherein the varying includes adding at least a part of the luminance value of the first sub-pixel corresponding to the first row included in the first image signal, which is to be reproduced by the first sub-pixel next to the fourth sub-pixel arranged at the terminal end of the first row by the conversion, to the luminance value of the first sub-pixel included in the second pixel arranged at the terminal end of the second row next to the first row.

[C13]

The display method of [C12], wherein the first sub-pixel is a sub-pixel outputting light corresponding to a red wavelength band, the second sub-pixel and the fourth sub-pixel are sub-pixels outputting light corresponding to a green wavelength band, and the third sub-pixel is a sub-pixel outputting light corresponding to a blue wavelength band.

[C14]

The display method of [C12], wherein the first sub-pixel is a sub-pixel outputting light corresponding to a red wavelength band, the second sub-pixel and the fourth sub-pixel include a sub-pixel outputting light corresponding to a wavelength band of a color between yellow and green and a sub-pixel outputting light corresponding to a wavelength band of a color between green and blue, respectively, and the third sub-pixel is a sub-pixel outputting light corresponding to a blue wavelength band.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A display device, comprising:

a display panel on which first pixels including first sub-pixels, second sub-pixels, third sub-pixels, and fourth sub-pixels arrayed in a row direction and constituting a first row of a pixel array, and second pixels including the first sub-pixels, the second sub-pixels, the third sub-pixels, and the fourth sub-pixels arrayed in the row direction and constituting a second row adjacent to the first row in a columnar direction in the pixel array are alternately arranged in the columnar direction; and a display controller configured to input a first image signal including luminance values of the first sub-pixels, the second sub-pixels, and the third sub-pixels corresponding to respective rows of the pixel array and to display an image on the display panel, wherein the first pixels and the second pixels are arranged such that the first sub-pixels included in the first pixels are adjacent to the third sub-pixels included in the second pixels in the columnar direction, and the display controller is configured to:

execute conversion of converting the input first image signal into a second image signal including luminance values of the first sub-pixels, the second sub-pixels, the third sub-pixels, and the fourth sub-pixels including converting the luminance values of two first sub-pixels, the luminance values of two second sub-pixels, and the luminance values of two third sub-pixels in the first image signal into the luminance value of one first sub-pixel, the luminance value of one second sub-pixel, the luminance value of one third sub-pixel, and the luminance value of one fourth sub-pixel, vary the luminance value of the third sub pixel included in the second image signal in the second row, based on the luminance value of the third sub-pixel which becomes unable to be represented beyond an end of the first row due to the pixel array based on the first pixels constituting the first row and the second pixels constituting the second row, if the conversion is executed, and display the image on the display panel, based on the second image signal in which the luminance values of the third sub-pixels are varied.

2. The display device of claim 1, wherein the first sub-pixel is arranged at a start end of the first row, and the fourth sub-pixel is arranged at a terminal end of the first row, the third sub-pixel is arranged at a start end of the second row, and the second sub-pixel is arranged at a terminal end of the second row, and the display controller is configured to add the luminance value of the third sub-pixel corresponding to the second row included in the first image signal, which is to be reproduced by a third sub-pixel next to the second sub-pixel arranged at the terminal end of the second row by the conversion, to the luminance value of the third sub-pixel included in the first pixel arranged at the terminal end of the first row next to the second row, and thereby vary the luminance value of the third sub-pixel.

3. The display device of claim 2, wherein the display controller is configured to add the luminance value of the third sub-pixel corresponding to the second row included in the first image signal, which is to be reproduced by the third sub-pixel included in the first pixel arranged at the start end of the first row by the conversion, to the luminance value of the third sub-pixel included in the second pixel arranged at the second row, and thereby vary the luminance value of the third sub-pixel.

4. The display device of claim 1, wherein the first sub-pixel is a sub-pixel outputting light corresponding to a red wavelength band, the second sub-pixel is a sub-pixel outputting light corresponding to a green wavelength band, the third sub-pixel is a sub-pixel outputting light corresponding to a blue wavelength band, and the fourth sub-pixel is a sub-pixel outputting light corresponding to a white wavelength band.

5. The display device of claim 2, wherein the display controller is configured to add at least a part of the luminance value of the first sub-pixel corresponding to the first row included in the first image signal, which is to be reproduced by the first sub-pixel next to the fourth sub-pixel arranged at the terminal end of the first row by the conversion, to the luminance value of the first sub-pixel included in the second pixel arranged at the terminal end of the second row next to the first row.

6. The display device of claim 5, wherein the first sub-pixel is a sub-pixel outputting light corresponding to a red wavelength band, the second sub-pixel and the fourth sub-pixel are sub-pixels outputting light corresponding to a green wavelength band, and the third sub-pixel is a sub-pixel outputting light corresponding to a blue wavelength band.

7. The display device of claim 5, wherein the first sub-pixel is a sub-pixel outputting light corresponding to a red wavelength band, the second sub-pixel and the fourth sub-pixel include a sub-pixel outputting light corresponding to a wavelength band of a color between yellow and green and a sub-pixel outputting light corresponding to a wavelength band of a color between green and blue, respectively, and the third sub-pixel is a sub-pixel outputting light corresponding to a blue wavelength band.

8. A display method executed by a display device comprising a display panel on which first pixels including first sub-pixels, second sub-pixels, third sub-pixels, and fourth sub-pixels arrayed in a row direction and constituting a first row of a pixel array, and second pixels including the first sub-pixels, the second sub-pixels, the third sub-pixels, and the fourth sub-pixels arrayed in the row direction and constituting a second row adjacent to the first row in a columnar direction in the pixel array are alternately arranged in the columnar direction, the method comprising:

inputting a first image signal including luminance values of the first sub-pixels, the second sub-pixels, and the third sub-pixels corresponding to respective rows of the pixel array; and displaying an image on the display panel, based on the input first image signal, wherein the first pixels and the second pixels are arranged such that the first sub-pixels included in the first pixels are adjacent to the third sub-pixels included in the second pixels in the columnar direction, and the displaying includes executing conversion of converting the input first image signal into a second image signal including luminance values of the first sub-pixels, the second sub-pixels, the third sub-pixels, and the fourth sub-pixels including converting the luminance values of two first sub-pixels, the luminance values of two second sub-pixels, and the luminance values of two third sub-pixels in the first image signal into the luminance value of one first sub-pixel, the luminance value of one second sub-pixel, the luminance value of one third sub-pixel, and the luminance value of one fourth sub-pixel, varying the luminance value of the third sub pixel included in the second image signal in the second row, based on the luminance value of the third sub-pixel which becomes unable to be represented beyond an end of the first row due to the pixel array based on the first pixels constituting the first row and the second pixels constituting the second row, if the conversion is executed, and displaying the image on the display panel, based on the second image signal in which the luminance values of the third sub-pixels are varied.

9. The display method of claim 8, wherein the first sub-pixel is arranged at a start end of the first row, and the fourth sub-pixel is arranged at a terminal end of the first row, the third sub-pixel is arranged at a start end of the second row, and the second sub-pixel is arranged at a terminal end of the second row, and the varying includes adding the luminance value of the third sub-pixel corresponding to the second row included in the first image signal, which is to be reproduced by a third sub-pixel next to the second sub-pixel arranged at the terminal end of the second row by the conversion, to the luminance value of the third sub-pixel included in the first pixel arranged at the terminal end of the first row next to the second row.

10. The display method of claim 9, wherein the varying includes adding the luminance value of the third sub-pixel corresponding to the second row included in the first image signal, which is to be reproduced by the third sub-pixel included in the first pixel arranged at the start end of the first row by the conversion, to the luminance value of the third sub-pixel included in the second pixel arranged at the second row.

11. The display method of claim 8, wherein the first sub-pixel is a sub-pixel outputting light corresponding to a red wavelength band, the second sub-pixel is a sub-pixel outputting light corresponding to a green wavelength band, the third sub-pixel is a sub-pixel outputting light corresponding to a blue wavelength band, and the fourth sub-pixel is a sub-pixel outputting light corresponding to a white wavelength band.

12. The display method of claim 9, wherein the varying includes adding at least a part of the luminance value of the first sub-pixel corresponding to the first row included in the first image signal, which is to be reproduced by the first sub-pixel next to the fourth sub-pixel arranged at the terminal end of the first row by the conversion, to the luminance value of the first sub-pixel included in the second pixel arranged at the terminal end of the second row next to the first row.

13. The display method of claim 12, wherein the first sub-pixel is a sub-pixel outputting light corresponding to a red wavelength band, the second sub-pixel and the fourth sub-pixel are sub-pixels outputting light corresponding to a green wavelength band, and the third sub-pixel is a sub-pixel outputting light corresponding to a blue wavelength band.

14. The display method of claim 12, wherein the first sub-pixel is a sub-pixel outputting light corresponding to a red wavelength band, the second sub-pixel and the fourth sub-pixel include a sub-pixel outputting light corresponding to a wavelength band of a color between yellow and green and a sub-pixel outputting light corresponding to a wavelength band of a color between green and blue, respectively, and the third sub-pixel is a sub-pixel outputting light corresponding to a blue wavelength band.

* * * * *